US008399867B2

(12) United States Patent
Endo et al.

(10) Patent No.: US 8,399,867 B2
(45) Date of Patent: Mar. 19, 2013

(54) EXTREME ULTRAVIOLET LIGHT SOURCE APPARATUS

(75) Inventors: Akira Endo, Hiratsuka (JP); Shinji Nagai, Hiratsuka (JP); Kouji Kakizaki, Hiratsuka (JP); Osamu Wakabayashi, Hiratsuka (JP); Yoshifumi Ueno, Hiratsuka (JP)

(73) Assignee: Gigaphoton Inc., Tokyo (JP)

( * ) Notice: Subject to any disclaimer, the term of this patent is extended or adjusted under 35 U.S.C. 154(b) by 201 days.

(21) Appl. No.: 12/566,170

(22) Filed: Sep. 24, 2009

(65) Prior Publication Data

US 2010/0078579 A1 Apr. 1, 2010

(30) Foreign Application Priority Data

Sep. 29, 2008 (JP) ..... 2008-250311
May 25, 2009 (JP) ..... 2009-125155

(51) Int. Cl.
*H04H 1/04* (2006.01)

(52) U.S. Cl. ..... 250/504 R

(58) Field of Classification Search ..... 250/504 R, 250/493.1; 378/119, 143
See application file for complete search history.

(56) References Cited

U.S. PATENT DOCUMENTS 4,704,718 A * 11/1987 Suckewer ..... 372/5
5,606,588 A * 2/1997 Umstadter et al. ..... 378/119
7,671,349 B2 * 3/2010 Bykanov et al. ..... 250/504 R
7,705,333 B2 * 4/2010 Komori et al. ..... 250/504 R
7,872,245 B2 * 1/2011 Vaschenko et al. ..... 250/492.2
2008/0237501 A1 * 10/2008 Hosokai et al. ..... 250/504 R
2010/0032590 A1 * 2/2010 Bykanov et al. ..... 250/504 R

FOREIGN PATENT DOCUMENTS

JP 2005-197456 7/2005

* cited by examiner

*Primary Examiner* — Kiet T Nguyen
(74) *Attorney, Agent, or Firm* — McDermott Will & Emery LLP

(57) ABSTRACT

An EUV light source apparatus in which contamination or damage of optical elements and other component elements by debris can be suppressed to realize longer lives of them. The EUV light source apparatus is an apparatus for radiating extreme ultraviolet light by generating plasma of a target material within a chamber, and includes: a first laser unit for applying a first laser beam to the target material to generate pre-plasma; a second laser unit for applying a second laser beam to the pre-plasma to generate a main plasma for radiating the extreme ultraviolet light; and a magnetic field generating unit for generating a magnetic field within the chamber to control a state of at least one of the pre-plasma and the main plasma.

22 Claims, 19 Drawing Sheets

FIRST LASER BEAM INTRODUCTION OPTICS

EXTREME ULTRAVIOLET LIGHT SOURCE APPARATUS

CROSS-REFERENCE TO RELATED APPLICATION

The present application claims priority from Japanese Patent Applications No. 2008-250311 filed on Sep. 29, 2008 and No. 2009-125155 filed on May 25, 2009, the contents of which are incorporated herein by reference in their entirety.

BACKGROUND OF THE INVENTION

1. Field of the Invention

The present invention relates to an extreme ultraviolet (EUV) light source apparatus to used as a light source in exposure equipment.

2. Description of a Related Art

In recent years, as semiconductor processes become finer, photolithography has been making rapid progress toward finer fabrication. In the next generation, microfabrication at 70 nm to 45 nm, further, microfabrication at 32 nm and beyond will be required. Accordingly, in order to fulfill the requirement for microfabrication at 32 nm and beyond, for example, exposure equipment is expected to be developed by combining an EUV light source for radiating EUV light having a wavelength of about 13 nm and reduced projection reflective optics.

As the EUV light source, there are three kinds of light sources, which include an LPP (laser produced plasma) light source using plasma generated by applying a laser beam to a target (hereinafter, also referred to as "LPP type EUV light source apparatus"), a DPP (discharge produced plasma) light source using plasma generated by discharge, and an SR (synchrotron radiation) light source using orbital radiation. Among them, the LPP light source has advantages that extremely high intensity close to black body radiation can be obtained because plasma density can be considerably made higher, that the light of only the particular waveband can be radiated by selecting the target material, and that an extremely large collection solid angle of $2\pi$ to $4\pi$ steradian can be ensured because it is a point light source having substantially isotropic angle distribution and there is no structure such as electrodes surrounding the light source. Therefore, the LPP light source is considered to be predominant as a light source for EUV lithography, which requires power of more than several tens watts.

In the LPP type EUV light source apparatus, EUV light is radiated on the following principle. That is, by supplying a target material into a vacuum chamber by using a nozzle and applying a laser beam to the target material, the target material is excited and turned into plasma. Various wavelength components including extreme ultraviolet (EUV) light are radiated from the plasma generated in this manner. Then, the EUV light is reflected and collected by using a collector mirror for selectively reflecting a desired wavelength component (e.g., 13.5 nm) among them, and inputted to an exposure unit. For example, as a collector mirror for collecting EUV light having a wavelength near 13.5 nm, a mirror having a reflecting surface on which molybdenum (Mo) and silicon (Si) thin films are alternately deposited is used.

In the LPP type EUV light source apparatus, there is a problem of an influence of ion particles and neutral particles emitted from the plasma. These particles (debris) fly to the surfaces of various optical elements such as an EUV collector mirror within the chamber. The fast ion debris with high energy erode the surfaces of the optical elements. On the other hand, slow ion debris and neutral particles are deposited on the surfaces of the optical elements. Due to the influence of the debris, the reflectivity of the surface of the optical elements becomes lower to be unusable.

As a related technology, Japanese Patent Application Publication JP-P2005-197456A discloses an extreme ultraviolet light source apparatus having magnetic field generating means for generating a magnetic field within collective optics to trap ion debris so that the ion debris emitted from plasma may not collide with a collector mirror.

However, in JP-P2005-197456A, because of moving of the ion debris with high energy along with the magnetic flux, the ion debris may collide with a target nozzle provided on the magnetic field axis. If the ion debris collide with the target nozzle, the nozzle is sputtered and changed in the shape of tip of the nozzle, and thereby, positional stability of droplets may be deteriorated and materials sputtered from the nozzle may adhere to the collector mirror and so on and reduce the reflectivity. Further, debris such as neutral particles cannot be trapped by the magnetic field but adhere to the surfaces of the collector mirror, and then, it causes the reflectivity reduction.

SUMMARY OF THE INVENTION

The present invention has been achieved in view of the above-mentioned problems. A purpose of the present invention is to provide an EUV light source apparatus in which contamination or damage of optical elements and other component elements by debris can be suppressed to realize longer lives of them.

In order to accomplish the above-mentioned purpose, an extreme ultraviolet light source apparatus according to one aspect of the present invention is an apparatus for radiating extreme ultraviolet light by generating plasma of a target material within a chamber, and includes: a first laser unit for applying a first laser beam to the target material to generate pre-plasma; a second laser unit for applying a second laser beam to the pre-plasma to generate a main plasma for radiating the extreme ultraviolet light; and a magnetic field generating unit for generating a magnetic field within the chamber to control a state of at least one of the pre-plasma and the main plasma.

According to the one aspect of the present invention, a magnetic field is generated by the magnetic field generating unit so as to control the state of at least one of the pre-plasma and the main plasma. As a result, production of ion debris can be suppressed and the produced ion debris can be removed by the magnetic field. Therefore, an EUV light source apparatus can be provided in which contamination and damage of optical elements and other component elements by debris can be suppressed to realize long life operation.

DESCRIPTION OF THE PREFERRED EMBODIMENTS

Figure 1B:
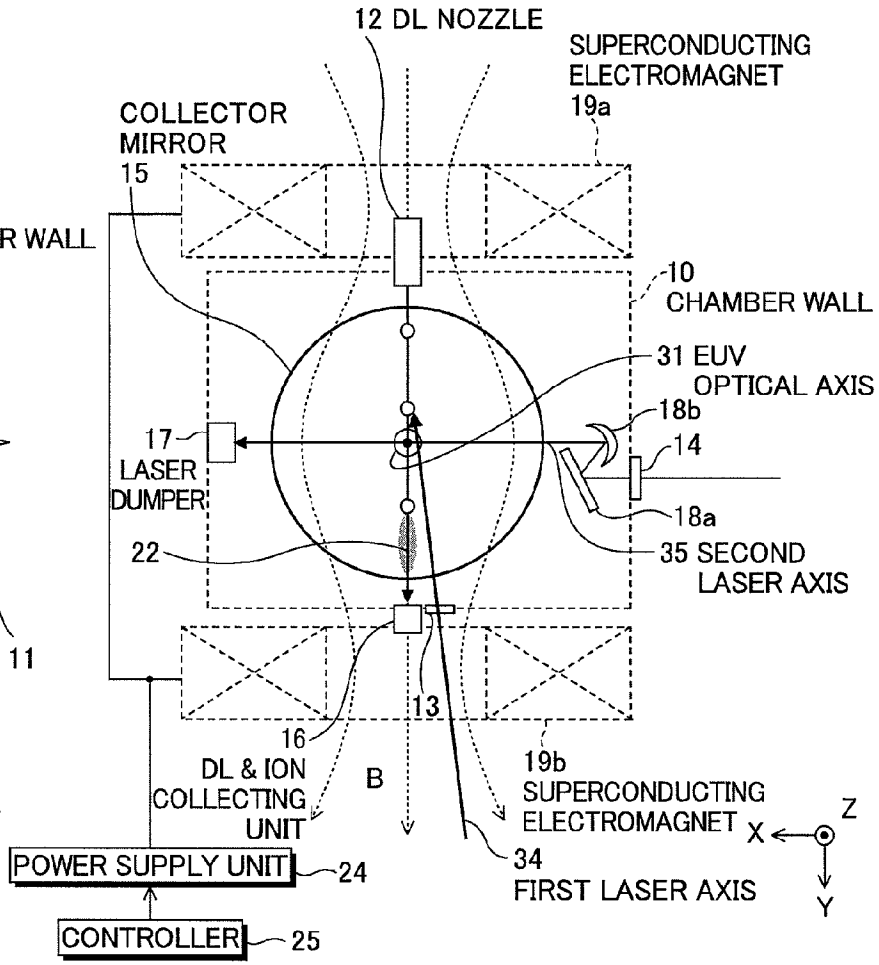
FIGS. 1A and 1B are a side view and a front view showing a schematic configuration of an extreme ultraviolet (EUV) light source apparatus according to the first embodiment.

Hereinafter, preferred embodiments of the present invention will be explained in detail by referring to the drawings. The same reference numerals are assigned to the same component elements and overlapping explanation will be omitted.

Figure 1A:
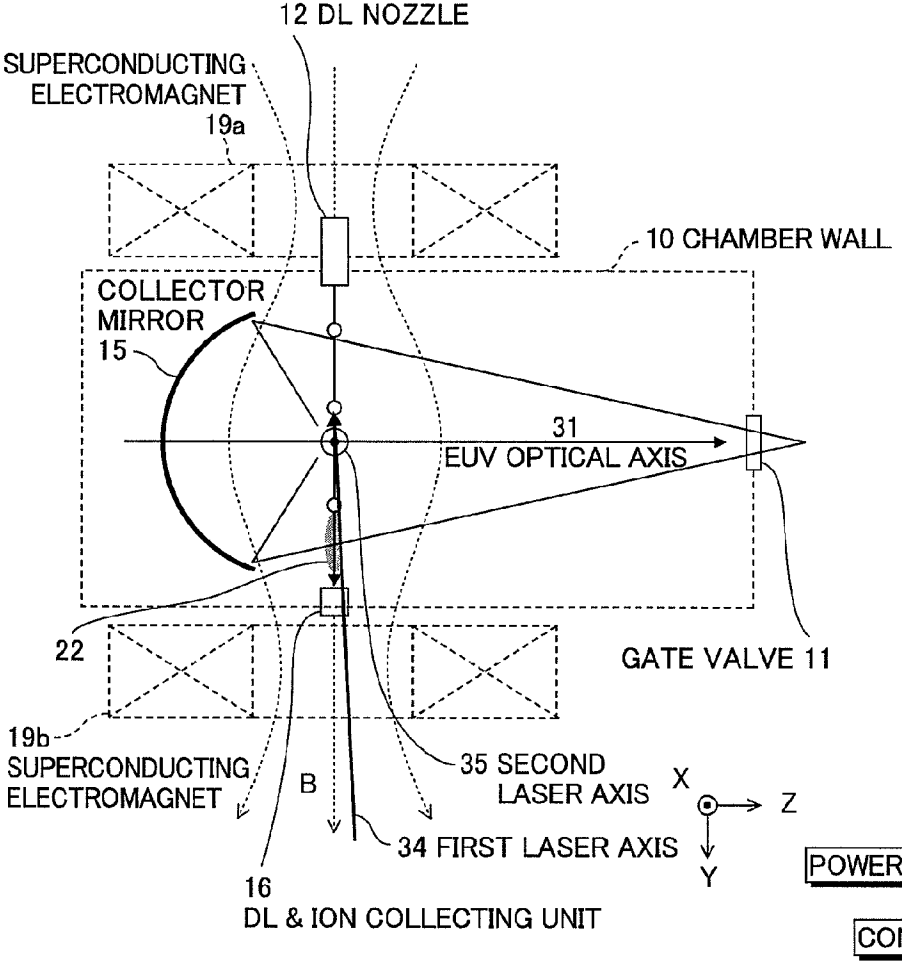

FIGS. 1A and 1B are a side view and a front view showing a schematic configuration of an extreme ultraviolet (EUV) light source apparatus according to the first embodiment. The extreme ultraviolet light source apparatus according to the embodiment employs a laser produced plasma (LPP) type for radiating EUV light by applying a laser beam to a target material for excitation. As shown in FIGS. 1A and 1B, the EUV light source apparatus includes a chamber defined by a chamber wall 10, a droplet (DL) nozzle 12, a first introduction window 13, a second introduction window 14, a collector mirror 15, a droplet and ion collecting unit 16, a laser dumper 17, superconducting electromagnets 19*a* and 19*b*, a power supply unit 24, a controller 25, and first and second laser oscillators (laser units) 50 and 60 (see FIG. 2B).

The droplet nozzle 12 injects a target material such as melted tin (Sn) supplied from a target supply unit through a bore of the superconducting electromagnet 19*a*, and thereby, supplies a droplet target material to a predetermined position (plasma emission point) within the chamber. The droplet nozzle 12 includes a vibration mechanism such as a piezoelectric element, and produces droplets from the target material on the following principle. That is, according to Rayleigh's stability theory of microdisturbance, when a target jet having a diameter "d" and flowing at a velocity "v" is vibrated at a frequency "f" to be disturbed, in the case where a wavelength "λ" (λ=v/f) of the vibration generated in the target jet satisfies a predetermined condition (e.g., λ/d=4.51), uniformly-sized droplets are repeatedly formed at the frequency "f". The frequency "f" is called a Rayleigh frequency.

The first introduction window 13 and the second introduction window 14 transmit a first laser beam and a second laser beam outputted from the first and second laser oscillators 50 and 60 provided outside of the chamber to introduce them into the chamber, respectively. The first laser beam and the second laser beam are pulse laser beams each having a high repetition rate (e.g., the pulse width is about several nanoseconds to several tens of nanoseconds, and the repetition rate is about 10 kHz to 100 kHz). As the first laser oscillator, for example, a YAG laser is used, and as the second laser oscillator, for example, a $CO_2$ laser is used. However, other laser oscillators may be used. The first laser beam is focused on droplets via the first introduction window 13 by focusing optics. Within the chamber, there are provided a reflecting mirror 18*a* for reflecting the second laser beam introduced from the second introduction window 14, and a laser beam focusing off-axis paraboloidal mirror 18*b* for reflecting and focusing the reflected second laser beam in a predetermined direction.

The first laser beam is focused and applied onto the droplets. In this regard, if the first laser beam is applied at intensity that breaks and scatters the droplets, a lot of debris made of tiny particles and neutral particles of the broken and scattered droplets are produced. Accordingly, the first laser beam is applied in intensity that does not break or scatter the droplets. When the first laser beam is applied in this manner, pre-plasma is generated on the droplet surfaces. The pre-plasma is estimated to be in a state that a part near the surface of the droplet irradiated with the first laser beam is turned into plasma or in a state of mixture of neutral (atomic) gas and plasma. Or the pre-plasma is estimated to be in a state that a part near the surface of the droplet irradiated with the first laser beam is in a cold plasma state to a degree that emits no EUV light or in a state of mixture of neutral (atomic) gas and this cold plasma. Here, plasma is an ionized gas in which electrons are ionized from atoms and positive ions and electrons are mixed.

In the following explanation and drawings, the state of cold plasma or mixture of plasma and neutral (atomic) gas is referred to as pre-plasma. Among the droplets irradiated with the first laser beam, the droplets, which have not been turned into pre-plasma nor broken, keep traveling almost straight within the chamber without being scattered. The range of application intensity of the first laser beam to the droplets for generating pre-plasma but not breaking the residue of the droplets is $10^7$ W/cm$^2$ to $10^9$ W/cm$^2$.

The second laser beam is not applied to the droplets but applied to the pre-plasma generated by the application of the first laser beam. When the pre-plasma is excited by the energy of the second laser beam, various wavelength components including EUV light are radiated therefrom. Here, the highest efficiency of EUV emission is provided in the case where the delay time of application interval between the first laser beam and the second laser beam is in a range from 50 ns to 100 ns.

The collector mirror 15 is collective optics for collecting a specified wavelength component (e.g., EUV light having a wave length near 13.5 nm) from various wavelength components radiated from the plasma. The collector mirror 15 has an ellipsoidal concave reflection surface on which a multilayer thin film of molybdenum (Mo)/silicon (Si) for selectively reflecting EUV light having a wavelength near 13.5 nm, for example, is formed. By the collector mirror 15, EUV light is reflected and focused in a predetermined direction (Z-direction in FIGS. 1A and 1B), and outputted via a gate valve 11 to the exposure unit, for example. The exposure unit is a unit for exposure of a mask pattern onto a work piece by using EUV light, and includes optics for uniformly illuminating a mask and optics for projecting the mask pattern onto a wafer to expose it to the EUV light.

The collecting unit 16 is provided in a location facing the droplet nozzle 12 with the plasma emission point in between. The collecting unit 16 collects the target material, which has been injected from the droplet nozzle 12 but not turned into plasma, and ions 22. Thereby, contamination of the collector mirror 15 and so on due to the scattered unnecessary target material is prevented and the loss of vacuum within the chamber is prevented.

The laser dumper 17 is a unit for receiving the radiated laser beam, and absorbs the high-energy second laser beam.

Each of the superconducting electromagnets 19*a* and 19*b* includes coil winding, a cooling mechanism for coil winding, and so on. These superconducting electromagnets 19*a* and 19*b* form a magnetic field generating unit. The power supply unit 24 with the controller 25 is connected to the superconducting electromagnets 19*a* and 19*b*, and the power supply unit 24 and the controller 25 adjust currents supplied to the respective superconducting electromagnets 19*a* and 19*b* to form a desired magnetic field within the vacuum chamber.

Here, advantages of using the first laser beam and the second laser beam will be explained.

In the embodiment, the droplets are not broken nor flicked off by the application of the first laser beam, and the second laser beam is not applied to the part of the droplets that has not been gasified, and thus, the amount of produced debris can be reduced. In addition, since the intensity of the first laser beam is low, if debris is produced by the application of the first laser beam, the debris have small energy, and the trajectory of the ion debris is easily controlled by the superconducting electromagnets 19*a* and 19*b*. The trajectory of the droplet is almost stationary by the application of the first and second laser beams, and the droplet is easily collected by the collecting unit 16. Further, the pre-plasma irradiated with the second laser beam has already been turned into pre-plasma, and debris due to the second laser beam is hardly produced.

Figure 2B:
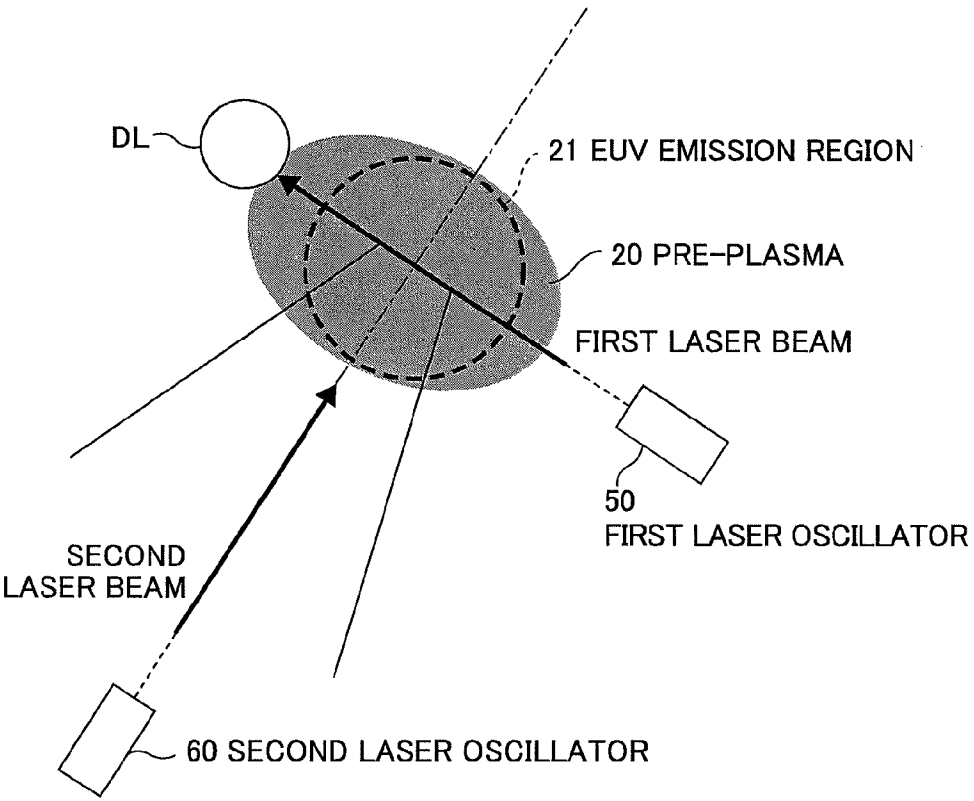
FIGS. 2A and 2B are conceptual diagrams for comparison between radiation of EUV light by single application of a laser beam to a droplet and radiation of EUV light by application of a first laser beam and a second laser beam according to the first embodiment.
Figure 2A:
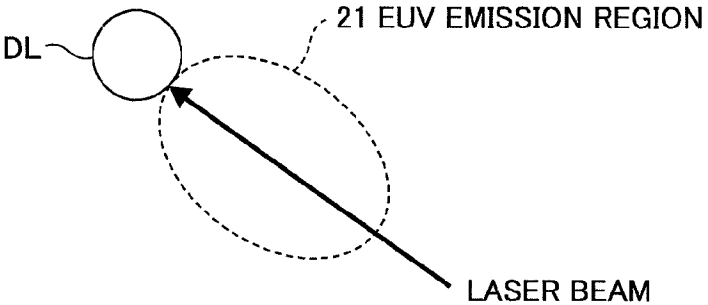

FIGS. 2A and 2B are conceptual diagrams for comparison between radiation of EUV light by single application of a laser beam to a droplet and radiation of EUV light by application of the first laser beam and the second laser beam according to the first embodiment.

In the case where EUV light is radiated by single application of a laser beam to a droplet DL as shown in FIG. 2A, a greater amount of plasma is generated at the laser beam source side of the droplet DL, and this part becomes an EUV emission region 21. The EUV light is emitted from the EUV emission region 21 in all directions. However, since the droplet DL is liquid, the droplet DL, which has not turned into plasma, inhibits the transmission of EUV light. Accordingly, in practice, EUV light having sufficient intensity can be extracted only at the laser beam source side. Furthermore, the laser beam is not applied in optimum plasma density, and the conversion efficiency of the energy of the applied laser beam into EUV light is low.

When the first laser beam is applied to the droplet DL as shown in FIG. 2B, pre-plasma 20 is generated at the first laser beam source side of the droplet DL. When the second laser beam is applied to the pre-plasma 20, the excited part of the pre-plasma becomes the EUV emission region 21, and EUV light is radiated. Since the pre-plasma 20 is expanded into the lower density than that of a melted metal, it hardly inhibits the transmission of the EUV light. Further, the remaining droplet DL, which has not turned into plasma, is apart from the EUV emission region 21 to a certain extent, and EUV light can be extracted in substantially all directions.

Figure 3B:
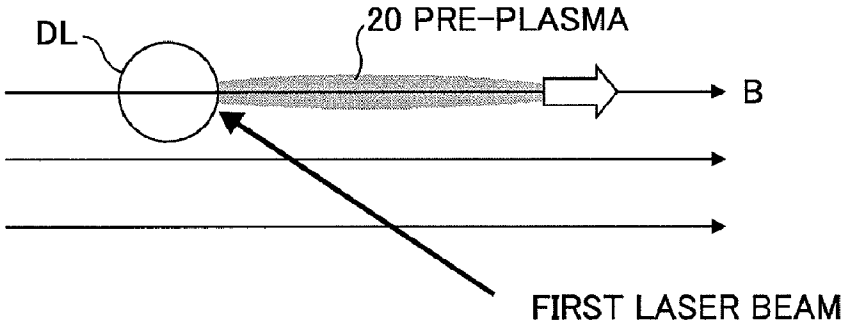
FIGS. 3A and 3B are conceptual diagrams showing generation of pre-plasma by application of the first laser beam to a droplet and application of a magnetic field to the pre-plasma.
Figure 3A:
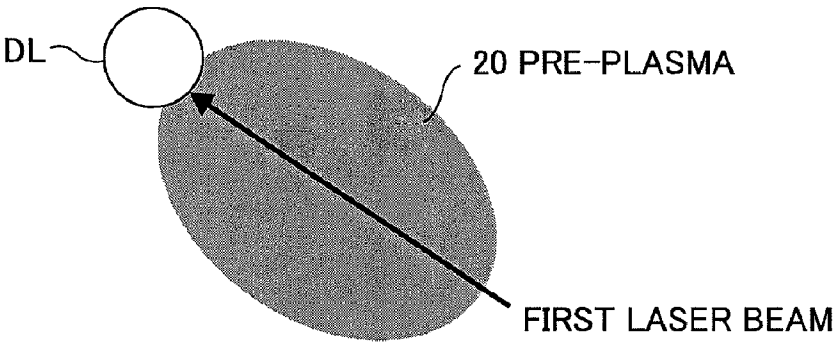

FIGS. 3A and 3B are conceptual diagrams showing generation of pre-plasma by application of the first laser beam to a droplet and application of a magnetic field to the pre-plasma. The pre-plasma 20 is generated at the first laser beam source side of the droplet DL as shown in FIG. 3A, and when the magnetic field "B" is applied thereto, it is found that the pre-plasma 20 converges in the direction of the magnetic field "B" as shown in FIG. 3B. Although the pre-plasma 20 includes ions, the first laser beam has intensity that does not break nor flick off the droplet DL. Accordingly, the energy of ions is lower, and therefore, it is estimated that the convergence effect by the magnetic field is higher. As a result, the density of pre-plasma becomes the optimum pre-plasma density for emission of EUV light.

Note that, the pre-plasma 20 has an initial velocity at time of generation, and the convergence effect is higher when the way of the pre-plasma 20 has a component parallel to the direction of the magnetic field "B". Accordingly, in order that the way of the pre-plasma 20 has a component parallel to the direction of the magnetic field "B", it is preferable to adjust the optical axis of the first laser beam such that the application direction of the first laser beam has a component parallel to the direction of the magnetic field "B". Further, it is desirable that the application direction of the first laser beam is nearer the direction parallel to the direction of the magnetic field "B" than the direction perpendicular to the direction of the magnetic field "B". In the present application, the direction of the magnetic field refers to the direction of the magnetic field near to the emission region of the pre-plasma.

Figure 4:
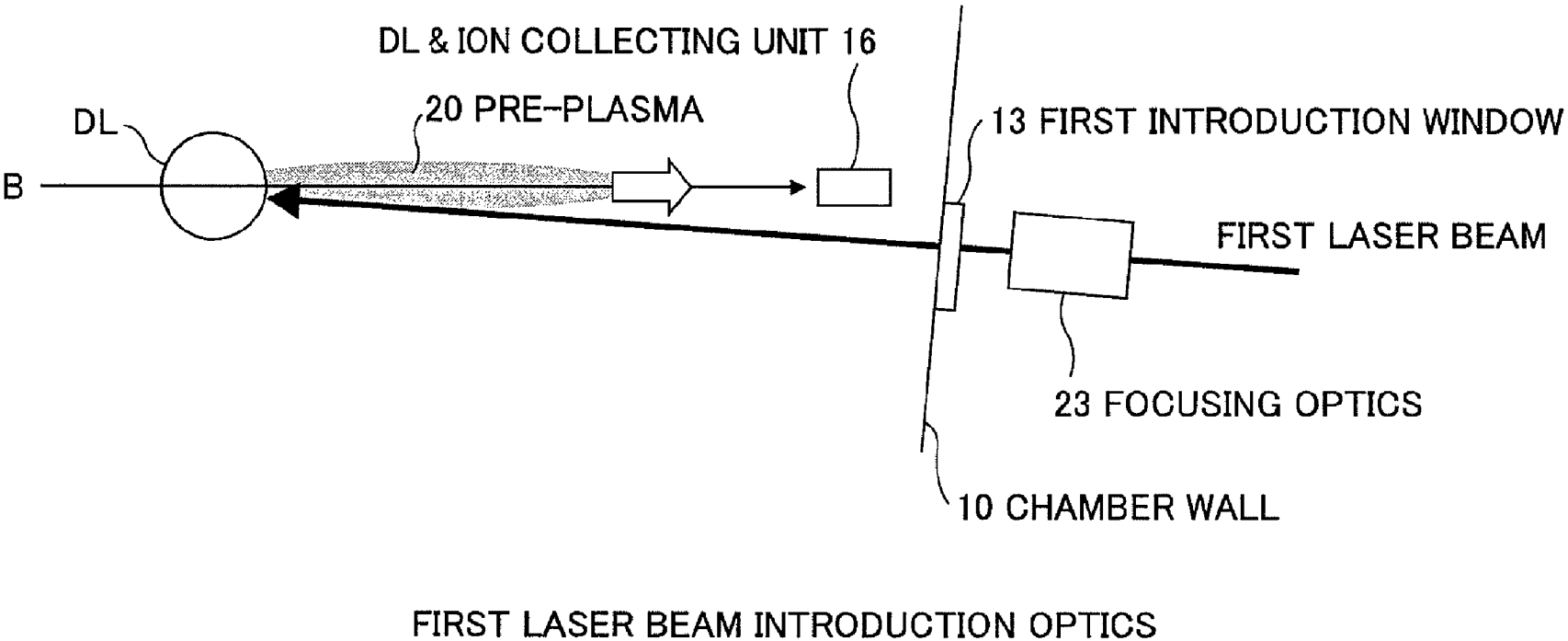
FIG. 4 shows an arrangement example of component elements for adjusting an application direction of the first laser beam and a direction of a magnetic field "B"

FIG. 4 shows an arrangement example of component elements for adjusting the application direction of the first laser beam and the direction of the magnetic field "B". The first laser beam is introduced from focusing optics 23 outside of the chamber through the first introduction window 13 into the chamber and applied to the droplet DL. Then, the pre-plasma 20 is generated from the droplet DL, converged in the direction of the magnetic field "B", and collected by the droplet and ion collecting unit 16. Here, in the case where the focusing optics 23 of the first laser beam can be made compact, the focusing optics 23 may be provided within the chamber in the same manner as the mirror and the off-axis paraboloidal mirror for the second laser beam as shown in FIG. 1B.

When the application direction of the first laser beam is made in parallel to the direction of the magnetic field "B", the way of the pre-plasma 20 and the direction of the magnetic field "B" are in parallel to each other, and the pre-plasma 20 is most easily converged. However, if the pre-plasma collides with the optics for the first laser beam, here, the first introduction window 13, the first introduction window 13 for the first laser beam is damaged and the transmittance is reduced. Accordingly, as shown in FIG. 4, it is desirable that the application direction of the first laser beam is made slightly out of alignment with the direction of the magnetic field "B".

On the basis of the above-mentioned points, there will be explained an arrangement of total five axes including an EUV optical axis 31 representing the optical axis direction of EUV light, a droplet axis 32 representing the injection direction of droplets, a magnetic field axis "B" representing the direction of, the magnetic field "B", a first laser axis 34 representing the optical axis direction of the first laser beam, and a second laser axis 35 representing the optical axis direction of the second laser beam.

Figure 5B:
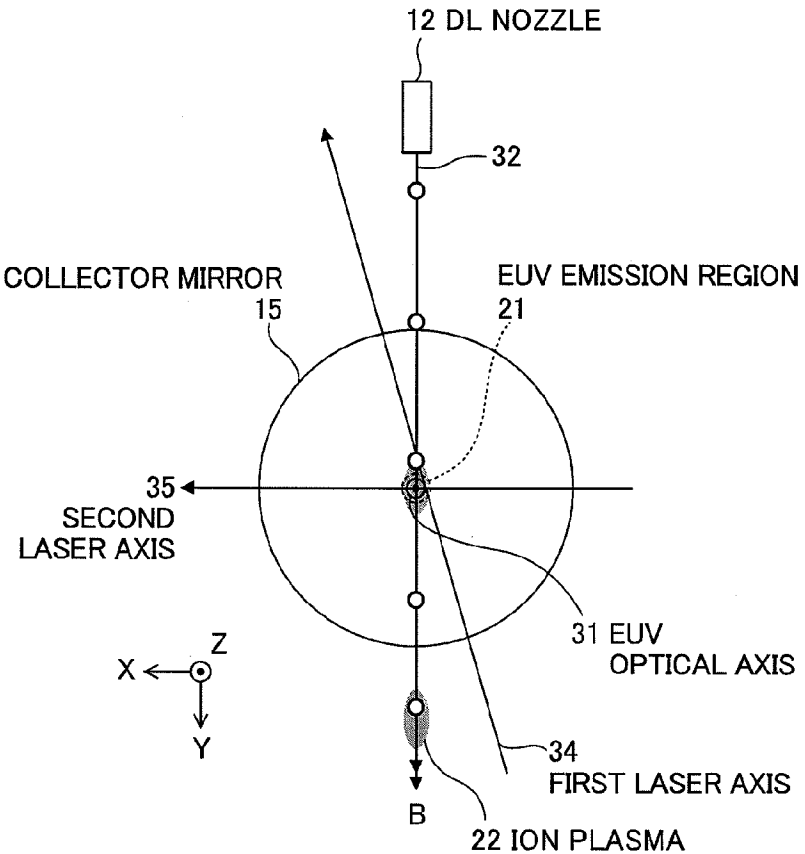
FIGS. 5A and 5B are a side view and a front view showing an arrangement of five axes in the EUV light source apparatus according to the first embodiment.
Figure 5A:
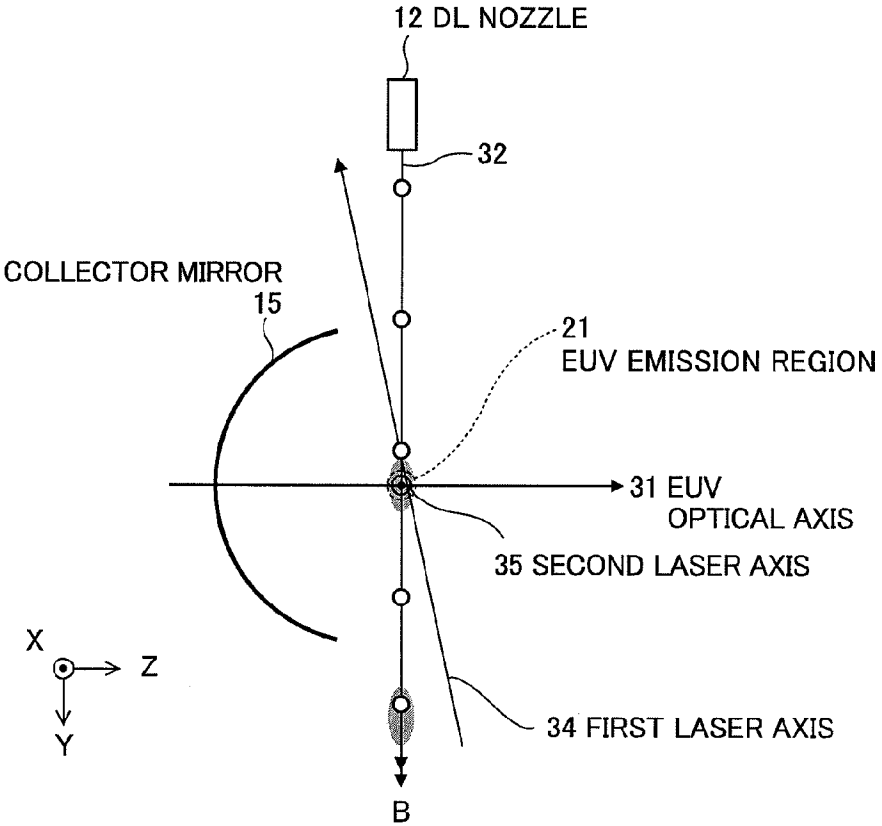

FIGS. 5A and 5B are a side view and a front view extractively showing an arrangement of five axes in the EUV light source apparatus according to the first embodiment.

In FIGS. 5A and 5B, the EUV optical axis 31 is in a direction from the plasma emission point toward the front surface side. The other four axes pass through the plasma emission point or nearby the plasma emission point.

The droplet axis 32 and the magnetic field axis "B" are in directions toward the bottom surface side, and substantially perpendicular to the EUV optical axis 31.

The first laser axis 34 is in a direction toward the upper surface side, substantially perpendicular to the EUV optical axis 31, and substantially opposite to the traveling direction in the droplet axis 32.

The second laser axis 35 is in a direction toward the left surface side, substantially perpendicular to the EUV optical axis 31, and substantially perpendicular to the droplet axis 32 and the magnetic field axis "B". Furthermore, the second laser axis 35 is almost perpendicular to the first laser axis 34.

In FIGS. 5A and 5B, the direction of the magnetic field axis "B" is downward, however, if it is upward, it may execute the same function. The reason is that the ions that have been turned into pre-plasma convergently move along the magnetic field axis regardless of the direction of the magnetic field axis "B".

Because of the above-mentioned axis arrangement, the embodiment has the following advantages.

(1) Since the first laser axis 34 is substantially in parallel to the magnetic field axis "B", the pre-plasma generated at the first laser beam source side can easily be converged by the magnetic field "B".

(2) Since the first laser axis 34 is substantially opposite to the droplet axis 32, the way of the pre-plasma by the first laser beam is substantially aligned with the traveling direction of the droplets, and trajectory control of the pre-plasma is easy.

(3) Since all of the droplet axis 32, the first laser axis 34, and the second laser axis 35 are substantially perpendicular to the EUV optical axis 31, it is unnecessary to bore a hole in the collector mirror 15 and the collection efficiency can be improved. Further, it is also unnecessary to place the laser dumper on the EUV optical axis and the collection efficiency can be improved.

(4) Since the second laser axis 35 is substantially perpendicular to the EUV optical axis 31 and substantially perpendicular to the first laser axis 34, the pre-plasma is generated substantially perpendicularly to the second laser axis 35. Therefore, the second laser beam can be hit on the pre-plasma so as not to collide with the residue droplet.

(5) The first laser axis 34 is substantially perpendicular but not completely perpendicular to the EUV optical axis 31, and slightly tilted to head from the downstream side toward the upstream side of the EUV optical axis. Accordingly, the pre-plasma is generated at an angle slightly tilted toward the downstream side of the EUV optical axis (in a direction slightly coming apart from the collector mirror 15), and the possibility of contamination or damage of the collector mirror 15 is reduced.

Next, the second embodiment will be explained.

Figure 6B:
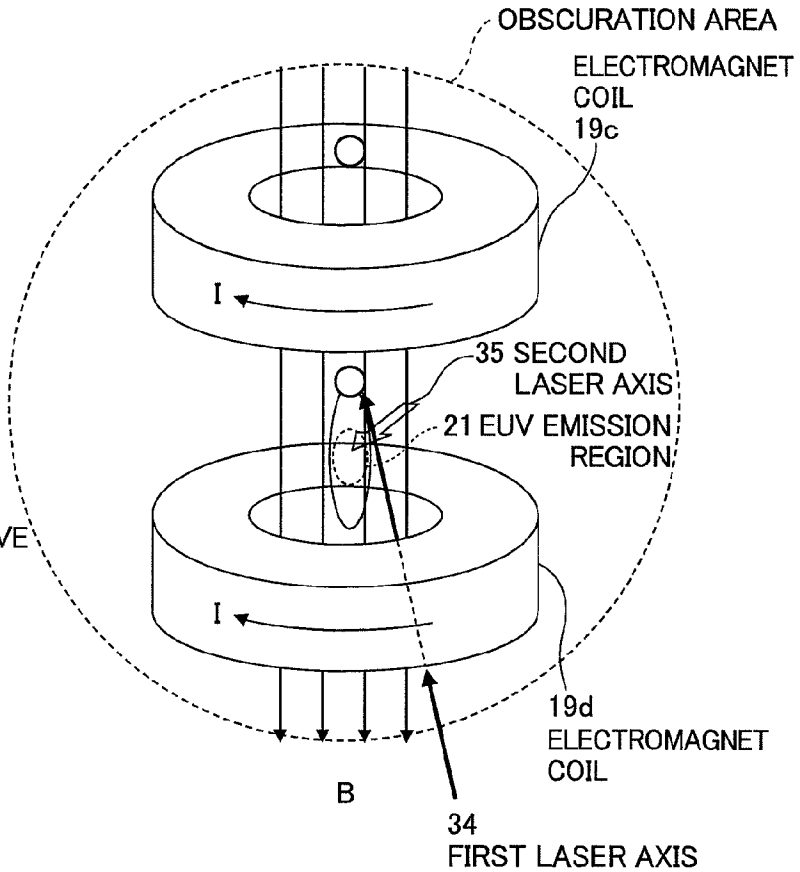
FIGS. 6A and 6B are a side view and a partially enlarged perspective view showing an arrangement of five axes in an EUV light source apparatus according to the second embodiment.
Figure 6A:
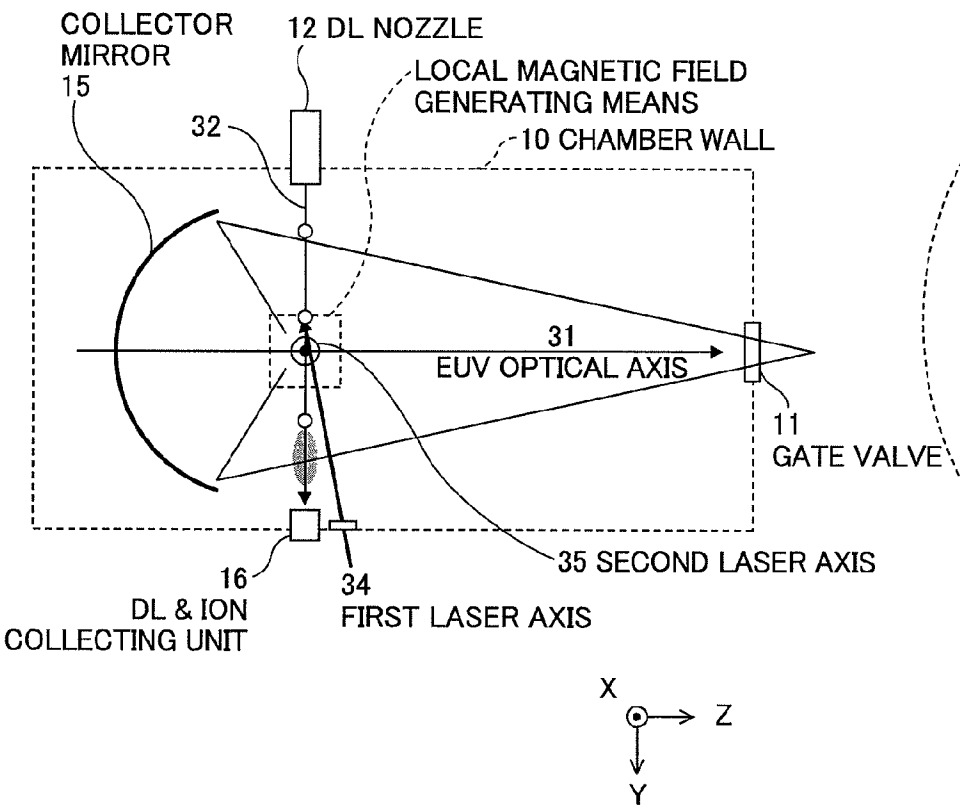

FIGS. 6A and 6B are a side view and a partially enlarged perspective view showing an arrangement of five axes in an EUV light source apparatus according to the second embodiment.

While the superconducting electromagnets 19*a* and 19*b* are provided outside of the chamber in the first embodiment, the second embodiment is different in that small electromagnet coils (local magnetic field generating means) 19*c* and 19*d* are provided within the chamber. In the second embodiment, by employing the electromagnet coils 19*c* and 19*d*, a local magnetic field "B" is generated within the chamber. Due to the local magnetic field "B", the pre-plasma is converged in the direction of the magnetic field "B", flows after passing through the electromagnet coil 19*d*, and is collected in the collecting unit 16. It is desirable that the shadow on the EUV light path by the electromagnet coils 19*c* and 19*d* is minimized to arrange the electromagnet coils 19*c* and 19*d* within an obscuration area determined by the exposure unit. Here, the obscuration area means an area with no problem in use of the exposure unit even if a component element is provided within the chamber.

According to the configuration of the second embodiment, the arrangement of five axes can be made the same as that in the first embodiment, and the second embodiment has the same advantages as those of the first embodiment. Further, according to the second embodiment, it is unnecessary to provide large superconducting electromagnets outside of the chamber, and the tolerance of the placement of the EUV light source in the exposure equipment is increased and the influence of leakage magnetic field must be negligible.

Next, the third embodiment will be explained.

Figure 7B:
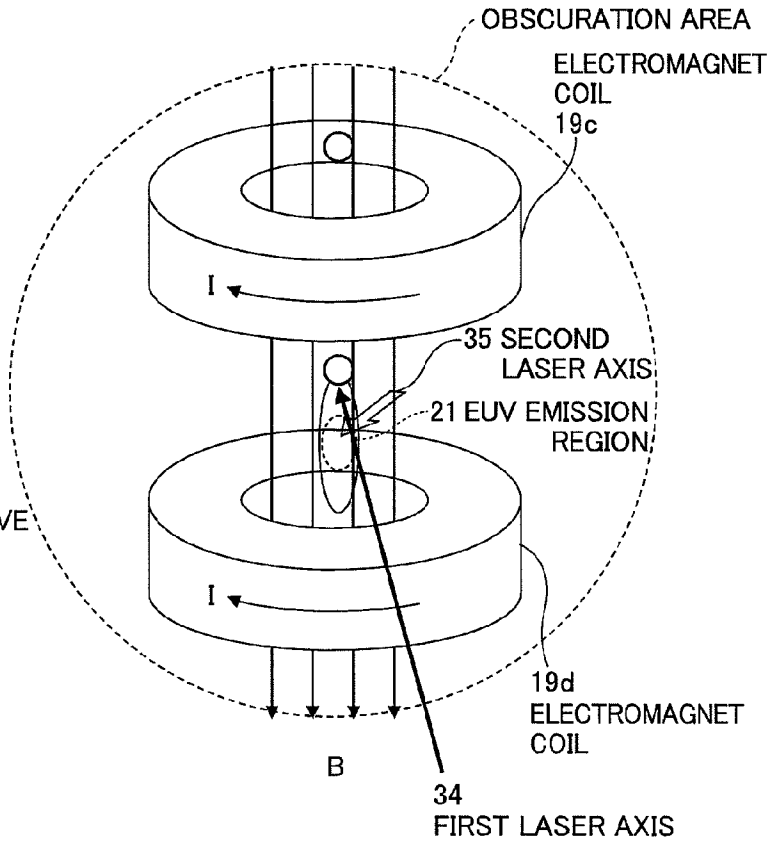
FIGS. 7A and 7B are a side view and a partially enlarged perspective view showing an arrangement of five axes in an EUV light source apparatus according to the third embodiment.
Figure 7A:
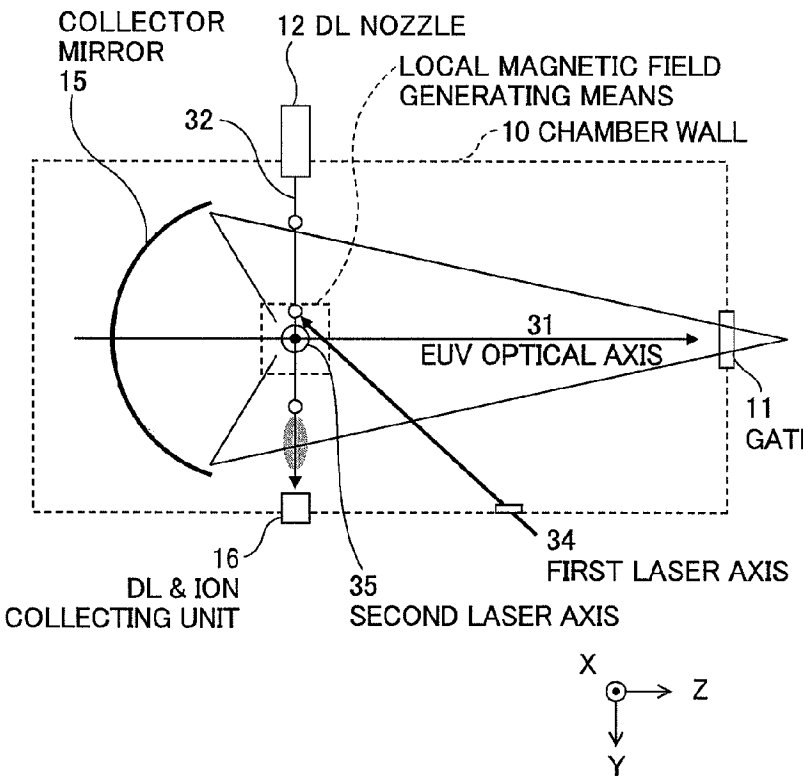

FIGS. 7A and 7B are a side view and a partially enlarged perspective view showing an arrangement of five axes in an EUV light source apparatus according to the third embodiment.

While the first laser axis 34 passes inside of either one of the electromagnet coils 19*c* and 19*d* toward the droplet in the second embodiment, the first laser axis 34 passes outside of the electromagnet coils 19*c* and 19*d*, i.e., between the electromagnet coil 19*c* and the electromagnet coil 19*d* toward the droplet in the third embodiment.

According to the third embodiment, the laser oscillator for generating the first laser beam or the focusing optics for focusing the first laser beam can be provided out of alignment with the convergence direction of the pre-plasma and the main plasma for radiating the EUV light by the magnetic field, and thereby, the damage and contamination on the optics for the first laser beam by the ion debris generated from the pre-plasma and the main plasma can be prevented.

Next, the fourth embodiment will be explained.

Figure 8B:
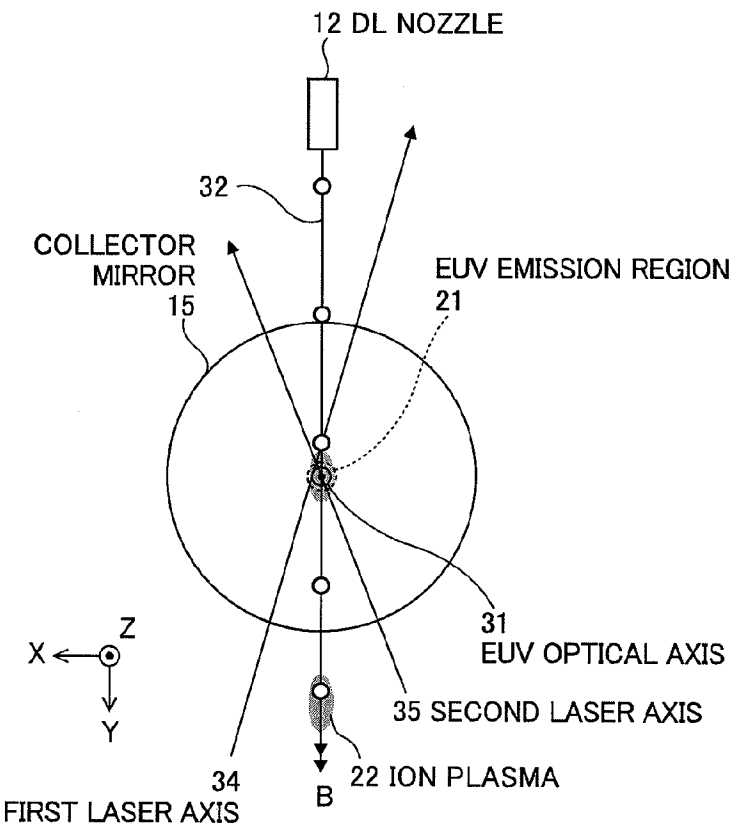
FIGS. 8A and 8B are a side view and a front view showing an arrangement of five axes in an EUV light source apparatus according to the fourth embodiment.
Figure 8A:
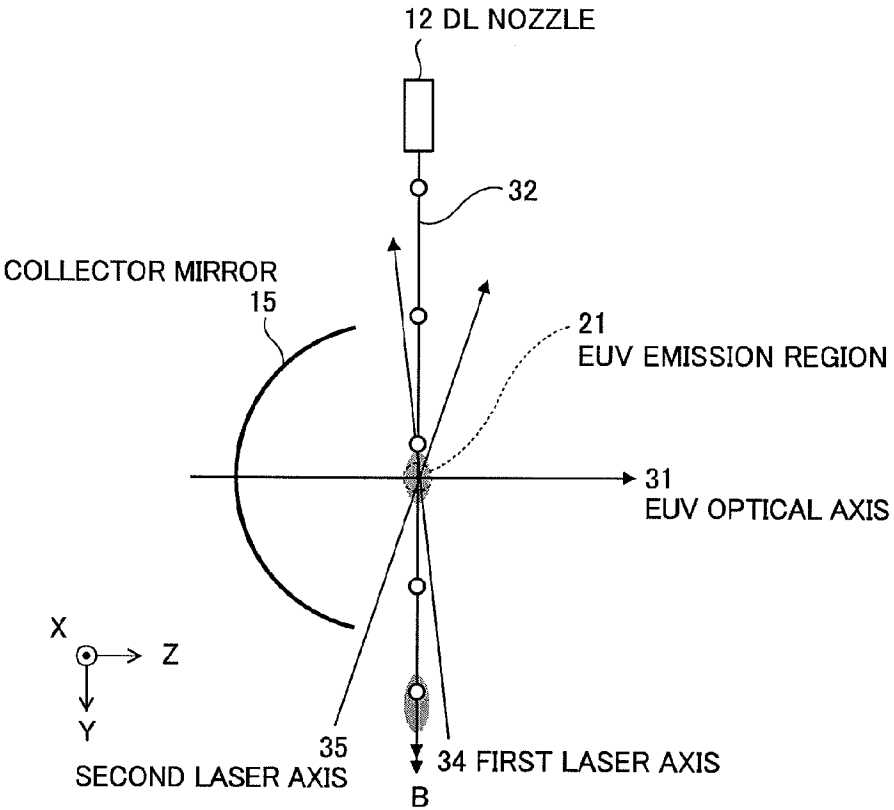

FIGS. 8A and 8B are a side view and a front view showing an arrangement of five axes in an EUV light source apparatus according to the fourth embodiment.

While the second laser axis 35 is in the direction toward the left surface side and substantially perpendicular to the droplet axis 32 and the magnetic field axis "B" in the first embodiment, the second laser axis 35 is in a direction toward the upper surface side and substantially opposite to the magnetic field axis "B" in the fourth embodiment.

The pre-plasma has an elongated shape extending in the direction of the magnetic field axis "B". Therefore, the fourth embodiment is effective in the case where the second laser beam can pass through and excite longer pre-plasma region by applying the second laser beam in the longitudinal direction of the pre-plasma.

Next, the fifth embodiment will be explained.

Figure 9B:
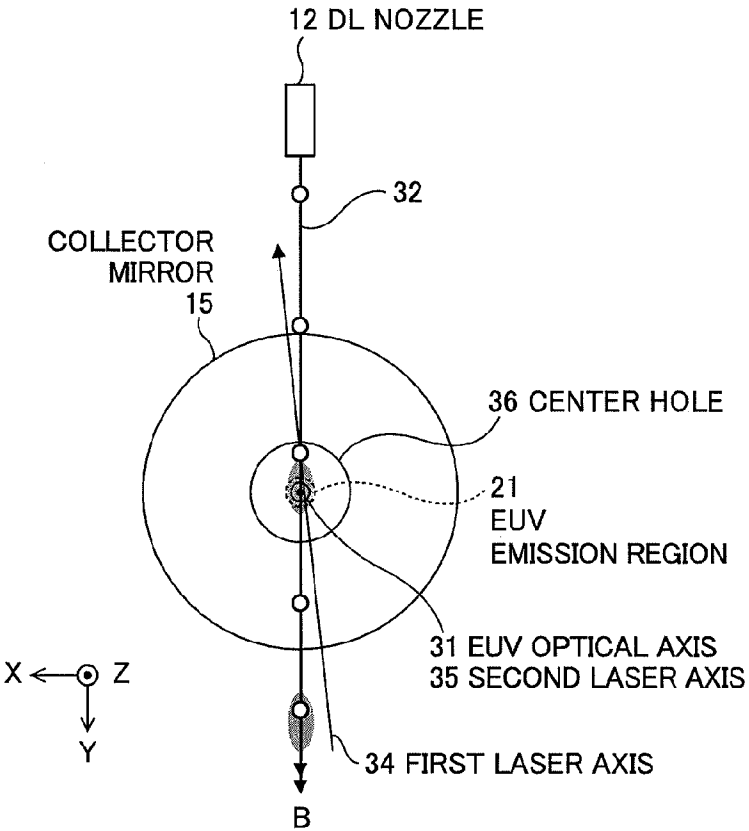
FIGS. 9A and 9B are a side view and a front view showing an arrangement of five axes in an EUV light source apparatus according to the fifth embodiment.
Figure 9A:
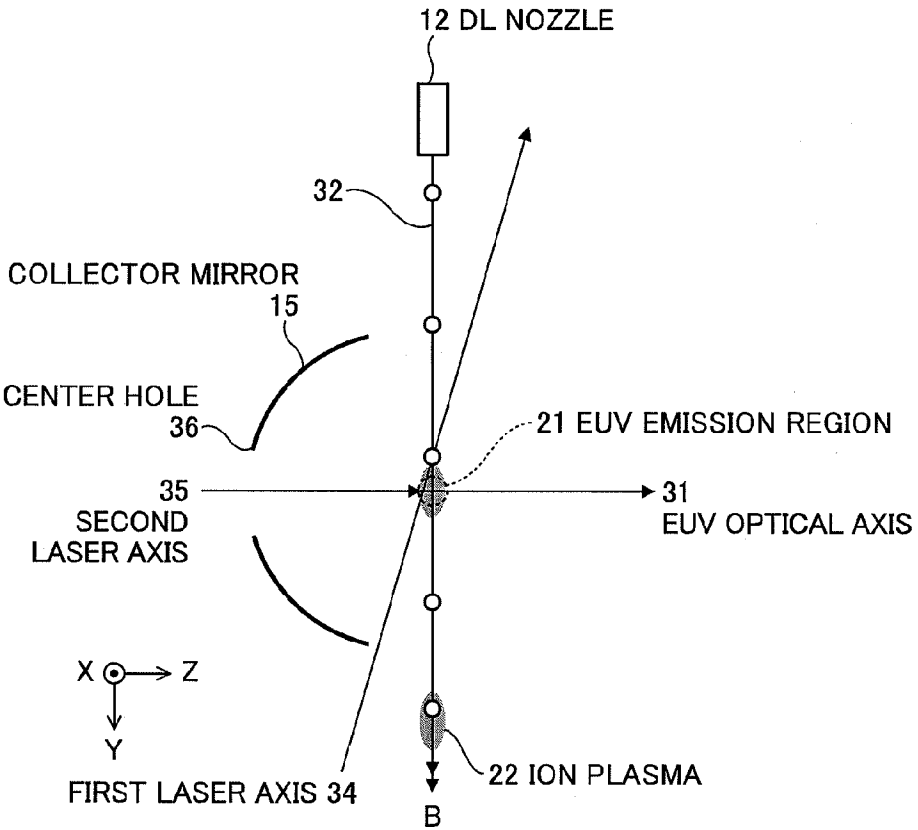

FIGS. 9A and 9B are a side view and a front view showing an arrangement of five axes in an EUV light source apparatus according to the fifth embodiment.

While the second laser axis 35 is in the direction toward the left surface side and substantially perpendicular to the EUV optical axis 31 in the first embodiment, the second laser axis 35 is in a direction toward the front surface side and substantially the same as the optical axis of the EUV light in the fifth embodiment.

In the first embodiment, it is explained that the EUV light is outputted in all directions in the case where the second laser beam is applied to the pre-plasma. However, it is possible that the strongest EUV light can be radiated at the light source side of the second laser beam depending on the intensity of the second laser beam, the pre-plasma density, or other conditions. For example, in the case where all of the second laser beam has been absorbed at the middle of the pre-plasma region, it is desirable that the second laser beam is applied from a center hole 36 formed in the collector mirror 15 to the EUV optical axis 31.

Next, the sixth embodiment will be explained.

Figure 10A:
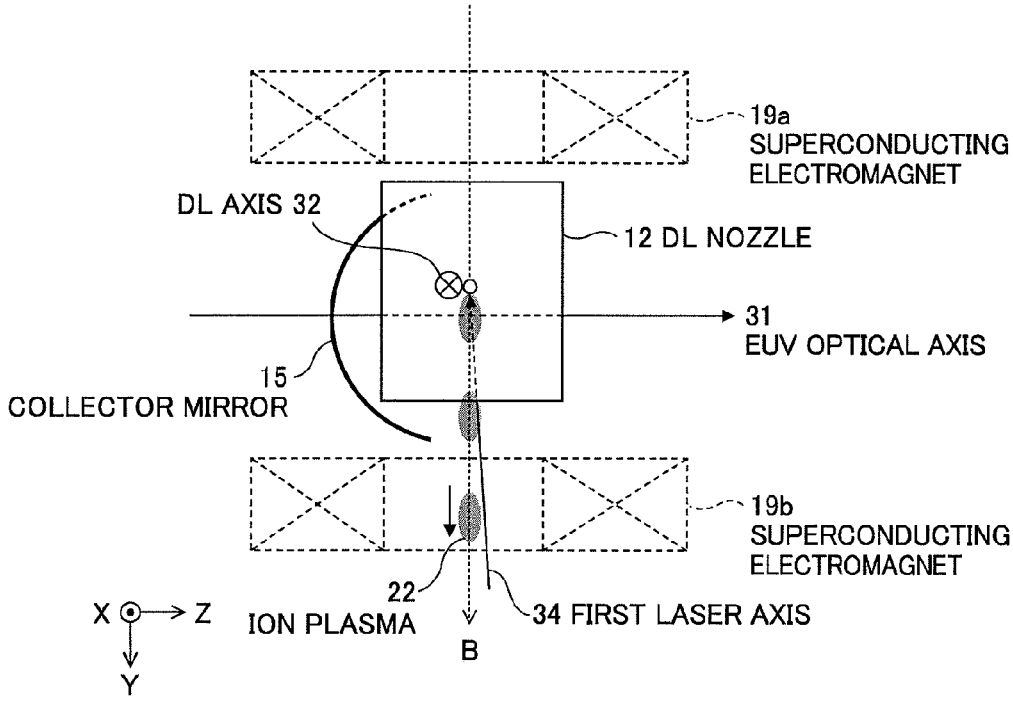
FIGS. 10A and 10B are a side view and a bottom view showing an arrangement of five axes in an EUV light source apparatus according to the sixth embodiment.
Figure 10B:
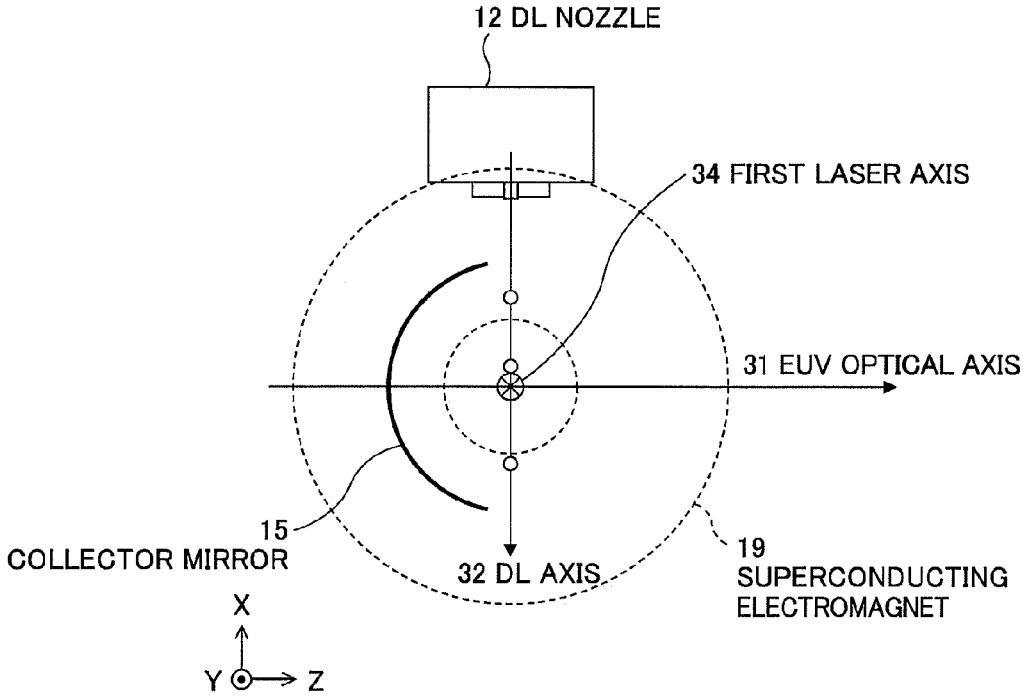

FIGS. 10A and 10B are a side view and a bottom view showing an arrangement of five axes in an EUV light source apparatus according to the sixth embodiment.

While the droplet axis 32 is in the direction toward the bottom surface side and substantially in parallel to the magnetic field axis "B" in the first embodiment, the droplet axis 32 is in a direction toward the side surface side and substantially perpendicular to the magnetic field axis "B" in the sixth embodiment. Not only in the embodiment, the same effect can be obtained when the direction of the magnetic field "B" is in the opposite direction.

In the case where the droplet nozzle 12 and the surrounding elements are too large to fit in the bores of the superconducting electromagnets 19*a* and 19*b*, it is desirable that the droplet nozzle 12 is provided on the side surface in this manner.

Here, the second laser axis is not shown. The second laser axis may be in a direction substantially perpendicular to the EUV optical axis 31 and substantially perpendicular to the magnetic field axis "B" in the same manner as the first embodiment, or substantially in the same direction as that of the magnetic field axis "B" in the same manner as the fourth embodiment, or substantially in the same direction as that of the EUV optical axis 31 in the same manner as the fifth embodiment.

Next, the seventh embodiment will be explained.

Figure 11B:
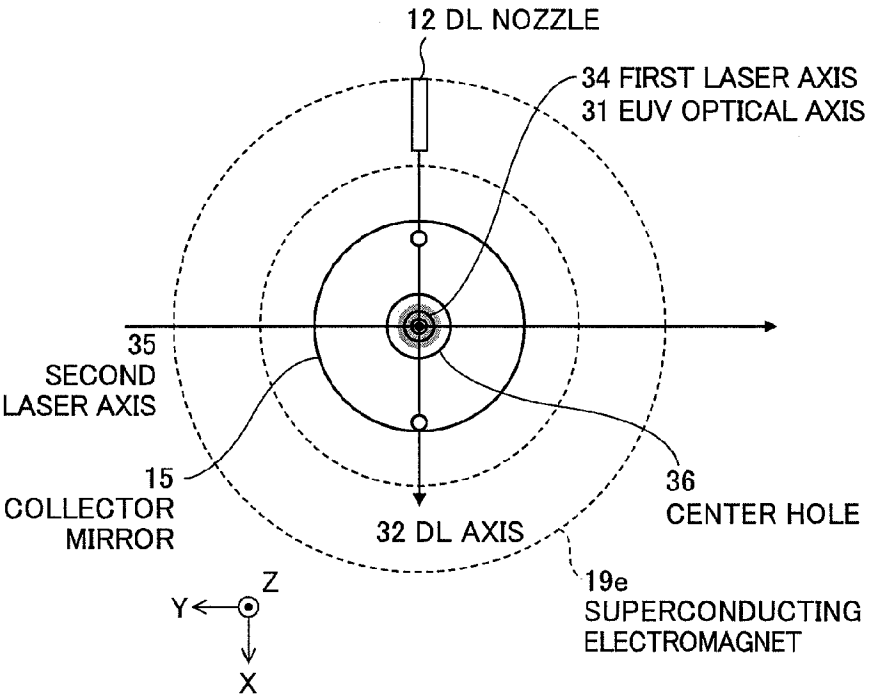
FIGS. 11A and 11B are a side view and a front view showing an arrangement of five axes in an EUV light source apparatus according to the seventh embodiment.
Figure 11A:
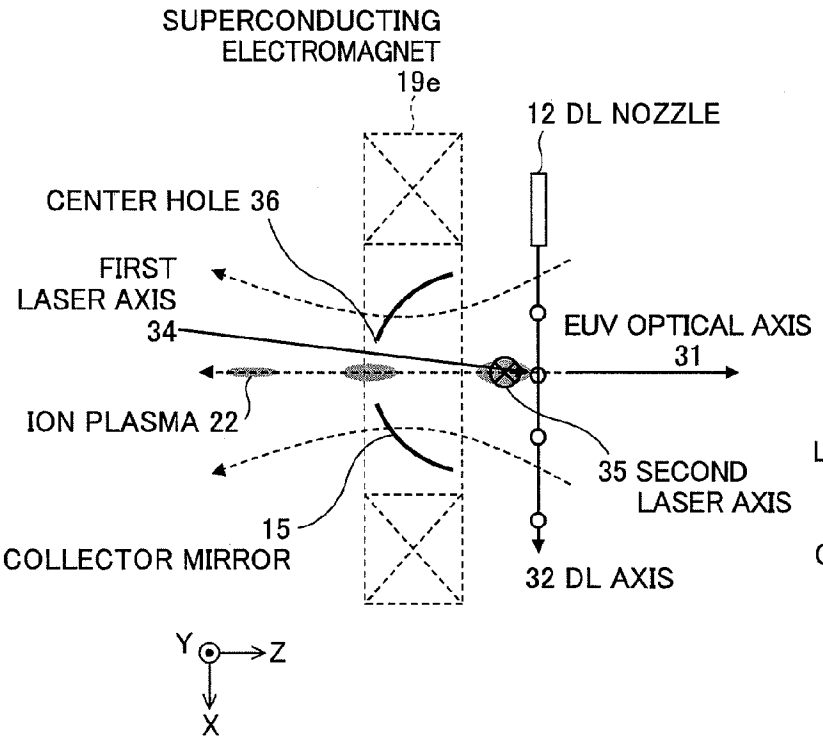

FIGS. 11A and 11B are a side view and a front view showing an arrangement of five axes in an EUV light source apparatus according to the seventh embodiment.

While the magnetic field axis "B" is in the direction toward the bottom surface side, the first laser axis 34 is in the direction toward the upper surface side, and both are substantially perpendicular to the EUV optical axis 31 in the first embodiment, the magnetic field axis "B" is in a direction toward the rear surface side and substantially opposite to the EUV optical axis 31, and the first laser axis 34 is in a direction toward the front surface side and substantially the same as that of the EUV optical axis 31 in the seventh embodiment.

In this case, the pre-plasma heads in the substantially opposite direction to the EUV optical axis 31, and it is necessary to guide ions toward the center hole 36 of the collector mirror 15. Accordingly, by providing the collector mirror 15 within the bore of the superconducting electromagnet 19*e*, the magnetic fluxes are concentrated at the position of the collector mirror 15. Not only in the embodiment, the same effect can be obtained when the direction of the magnetic field "B" is in the opposite direction.

According to the configuration, since the exposure unit (EUV optical axis) and the traveling direction of the optical axis of the first laser beam are substantially in the same direction and the magnetic field axis "B" is directed in parallel to the both axes, no debris flows to the exposure unit side. Therefore, the configuration has advantage for protecting the exposure unit from debris.

Further, since only one superconducting electromagnet 19*e* is required, the configuration is advantageous in cost and weight of the apparatus.

Next, the eighth embodiment will be explained.

Figure 12B:
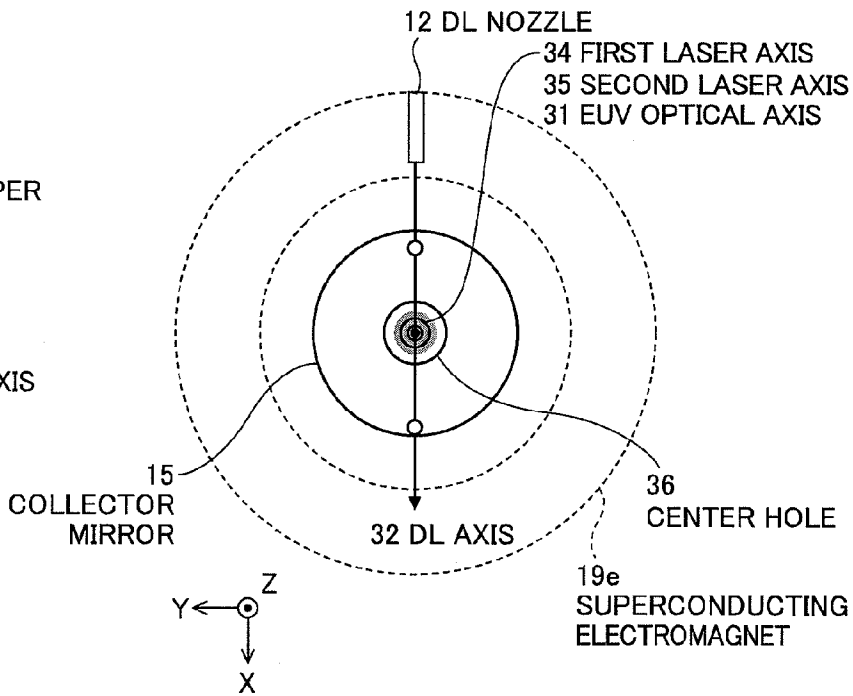
FIGS. 12A and 12B are a side view and a front view showing an arrangement of five axes in an EUV light source apparatus according to the eighth embodiment.
Figure 12A:
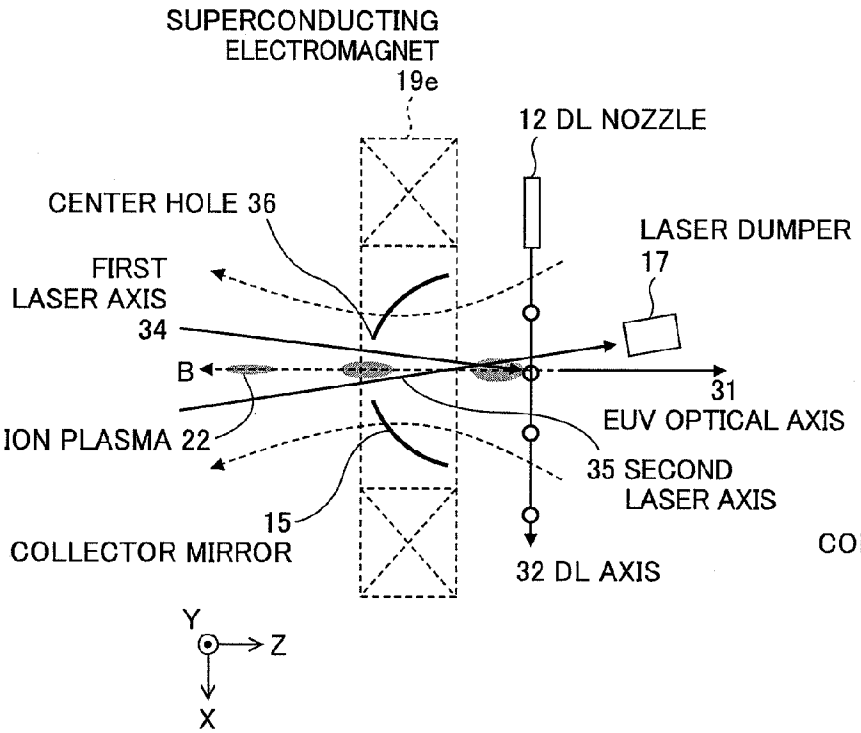

FIGS. 12A and 12B are a side view and a front view showing an arrangement of five axes in an EUV light source apparatus according to the eighth embodiment.

While the second laser axis 35 is in the direction substantially perpendicular to the EUV optical axis 31 in the seventh embodiment as is the case of the first embodiment, the second laser axis 35 is substantially in the same direction as that of the EUV optical axis in the eighth embodiment as is the case of the fifth embodiment. As a result, in the eighth embodiment, the second laser axis 35 is substantially in parallel to the magnetic field axis "B" as is the case of the fourth embodiment.

The configuration is advantageous in the case where the strongest EUV light can be extracted at the light source side of the second laser beam as is the case of the fifth embodiment in addition to the advantage according to the seventh embodiment. Further, the eighth embodiment is considered to be effective in the case where the second laser beam can pass through and excite longer pre-plasma region as is the case of the fourth embodiment.

In the above-mentioned first embodiment and fourth to sixth embodiments, the magnetic field is generated by using the two superconducting electromagnets 19*a* and 19*b*. However, the magnetic field generating means may not be limited to those. One superconducting electromagnet may be used, the local magnetic field as shown in the second embodiment may be used, or a permanent magnet may be used. Further, although the shape of the magnetic field is shown as a shape near a mirror magnetic field, the shape of the magnetic field is not limited to that, and an asymmetric shape may be used for preventing reflection of ions due to the mirror effect.

Furthermore, in the above-mentioned embodiments, the heated and melted tin (Sn) is used as the droplet target material. However, lithium (Li) may be used, or argon (Ar), Xenon (Xe), or the like may be liquefied or frozen to form droplets.

Figure 13B:
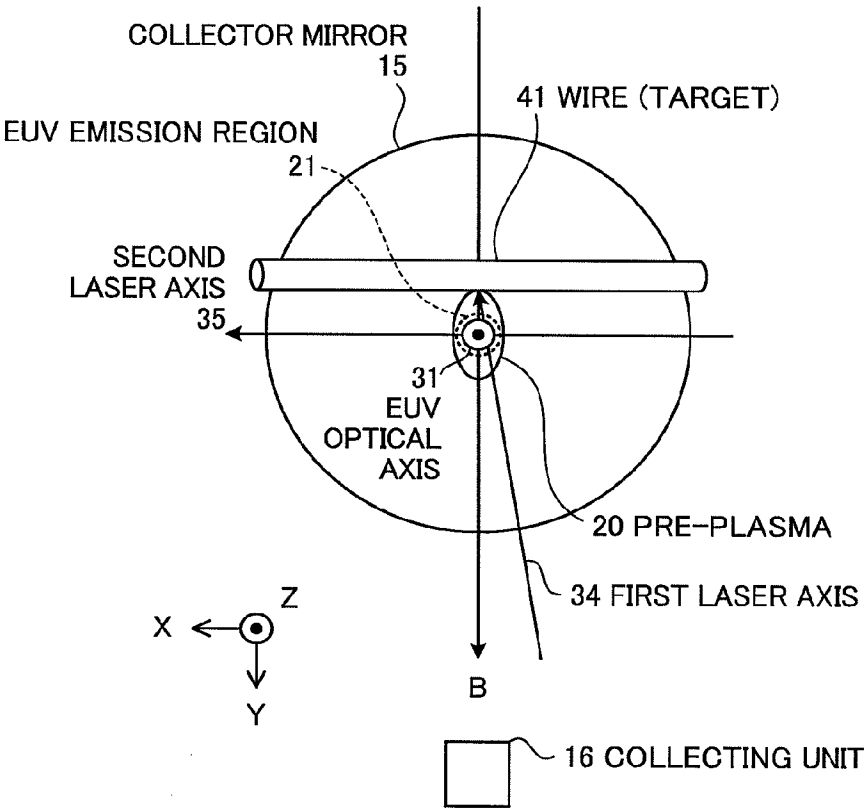
FIGS. 13A and 13B are a side view and a front view showing a schematic configuration within an EUV light source apparatus according to the ninth embodiment.
Figure 13A:
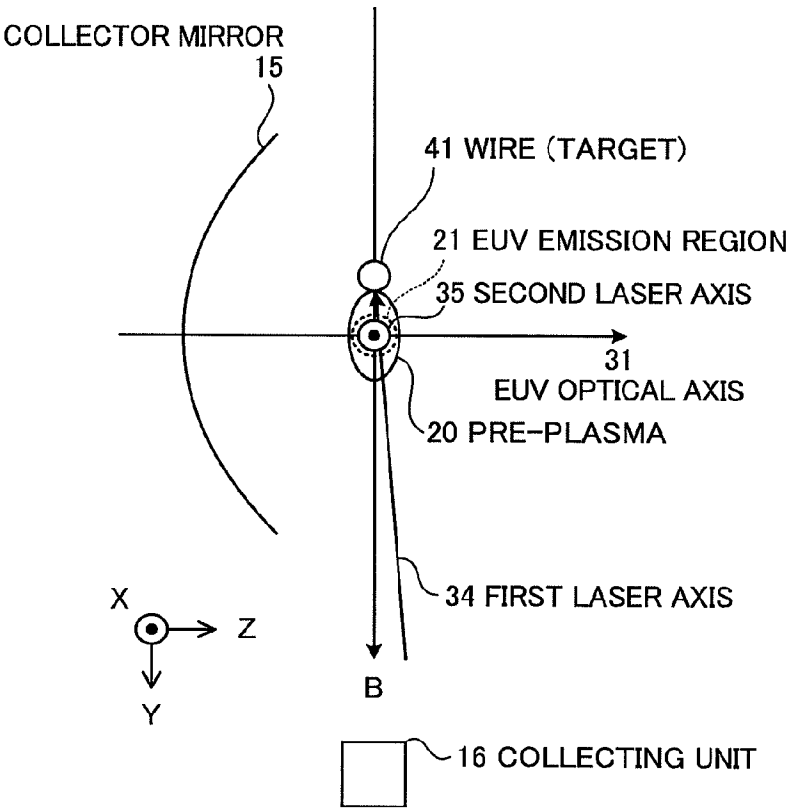

FIGS. 13A and 13B are a side view and a front view showing a schematic configuration within an EUV light source apparatus according to the ninth embodiment. As below, the explanation will be made with the right side in FIG. 13A as the front side, the left side in FIG. 13B as the left surface side, and the upside in the drawings as the upper surface side.

While the melted tin as a liquid is used as the target in the above-mentioned first to eighth embodiments, a wire 41 as a solid is used as the target in the ninth embodiment. The wire 41 is formed of tin (Sn), for example, or another material coated with tin.

In the ninth embodiment, the EUV optical axis 31 is in a direction from the plasma emission point toward the front surface side as is the case of the first embodiment.

The magnetic field axis "B" is formed in a direction toward the bottom surface side. The direction of the magnetic field axis "B" is a direction substantially perpendicular to the EUV optical axis 31. The magnetic field axis "B" is formed by superconducting electromagnets provided outside of the chamber as is the case of the first embodiment.

The first laser axis 34 is formed in a direction toward the upper surface side. The direction of the first laser axis 34 is a direction substantially perpendicular to the EUV optical axis 31.

The second laser axis 35 is formed in a direction toward the left surface side. The direction of the second laser axis 35 is a direction substantially perpendicular to the EUV optical axis 31, also substantially perpendicular to the magnetic field axis "B", and further, substantially perpendicular to the first laser axis 34.

In FIGS. 13A and 13B, the direction of the magnetic field axis "B" is downward. However, even when the direction of the magnetic field axis "B" is upward, it may execute the same function. The reason is that the ions, which have been turned into pre-plasma, converge and move along the magnetic field axis regardless of the direction of the magnetic field axis "B".

The wire 41 is provided such that the axis direction of the wire 41 is in a direction substantially perpendicular to the direction of the magnetic field axis "B" and the direction of the EUV optical axis 31. In the arrangement, the first laser beam is applied to the surface of the wire 41 along the first laser axis 34 at an angle slightly shifted with respect to the direction of the magnetic field axis "B", and thereby, the pre-plasma 20 can be generated substantially in the same direction as the direction of the magnetic field axis "B". By applying the second laser beam to the pre-plasma 20, EUV light can be radiated from the EUV emission region 21. By moving the wire 41 sequentially in the axis direction of the wire 41, the first laser beam can be applied to the new surface of the wire 41 to generate the pre-plasma 20.

According to the configuration of the ninth embodiment, since the solid target is used, compared to the case of the liquid target, the target is turned into pre-plasma by direct ablation from the solid-state, and thereby, the amounts of produced debris and neutral particles become smaller, and the ratio of the pre-plasma in the target material flying within the chamber becomes higher. Therefore, the probability of contamination or damage of optical components such as the collector mirror 15 by the debris and neutral particles can be suppressed.

Further, because of the high ratio of pre-plasma, the radiation efficiency of the EUV light is improved.

Figure 14B:
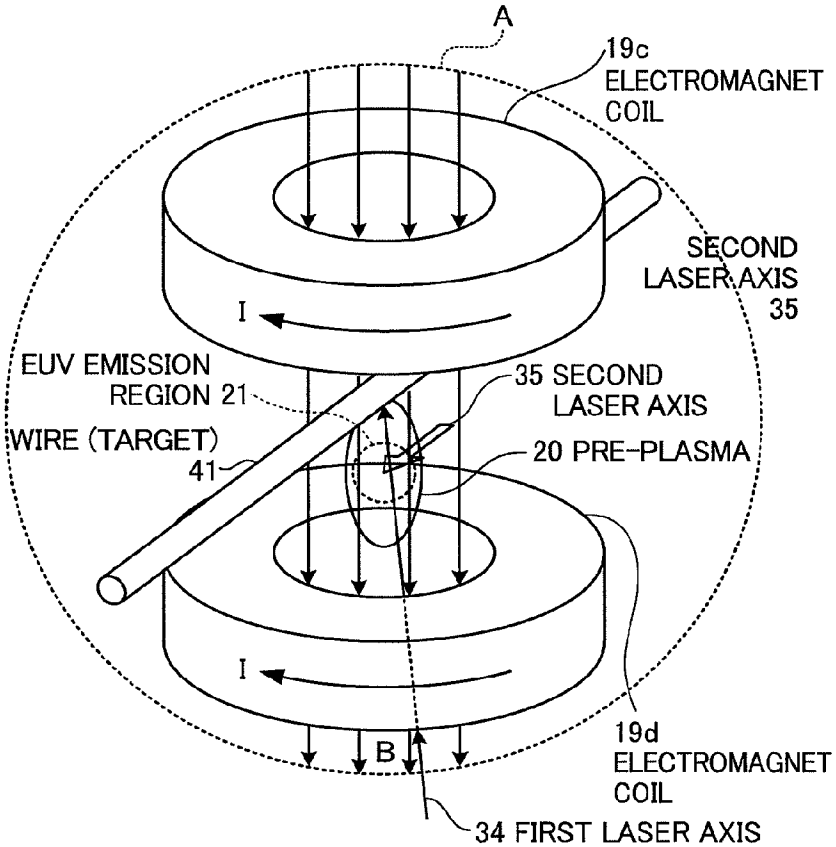
FIGS. 14A and 14B are a side view and an enlarged perspective view within a circle "A" showing a schematic configuration within an EUV light source apparatus according to the tenth embodiment.
Figure 14A:
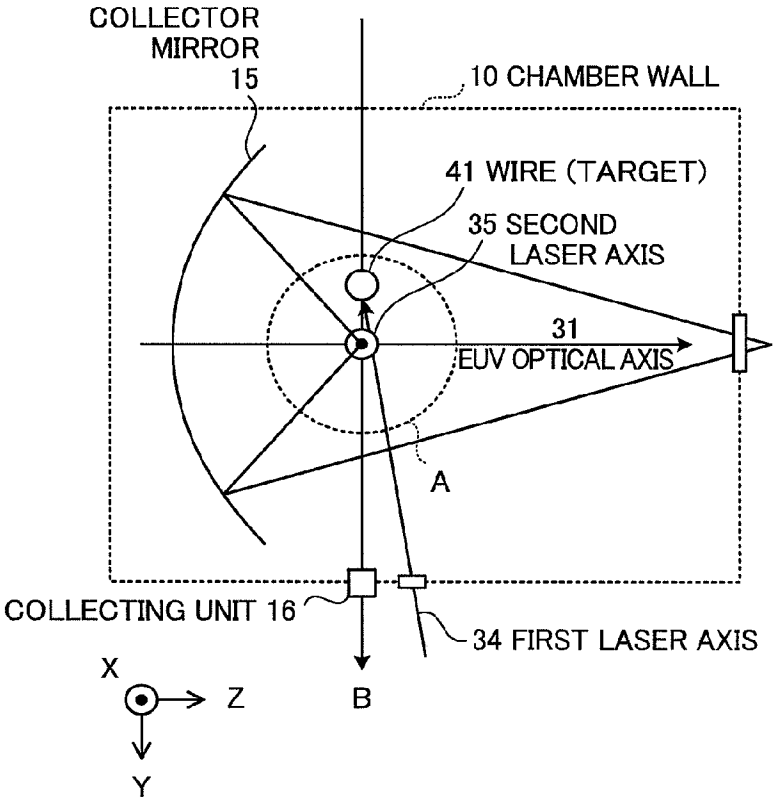

FIGS. 14A and 14B are a side view and an enlarged perspective view within a circle "A" showing a schematic configuration within an EUV light source apparatus according to the tenth embodiment.

While the superconducting electromagnets are provided outside of the chamber in the above-mentioned ninth embodiment, the tenth embodiment is different in that small electromagnet coils 19*c* and 19*d* are provided within the chamber. In the tenth embodiment, by using the electromagnet coils 19*c* and 19*d*, a local magnetic field "B" is generated within the chamber. By the local magnetic field "B", the pre-plasma converges in the direction of the magnetic field "B", flows at the unchanged speed after passing through the electromagnet coil 19*d*, and is collected in the collecting unit 16. It is desirable that the influence of the EUV light blocked by the electromagnet coils 19*c* and 19*d* is minimized by arranging the electromagnet coils 19*c* and 19*d* within an obscuration area determined by the exposure unit. Here, the obscuration area means an area with no problem in use of the exposure unit even if a component element is provided within the chamber.

According to the configuration of the tenth embodiment as well, the arrangement of the wire 41 and so on can be made the same as that in the ninth embodiment, and the tenth embodiment has the same advantages as those of the ninth embodiment. Further, according to the tenth embodiment, it is unnecessary to provide large superconducting electromagnets outside of the chamber, and the tolerance of the placement of the EUV light source in the exposure equipment is increased and the influence of leakage magnetic field must be negligible.

Figure 15A:
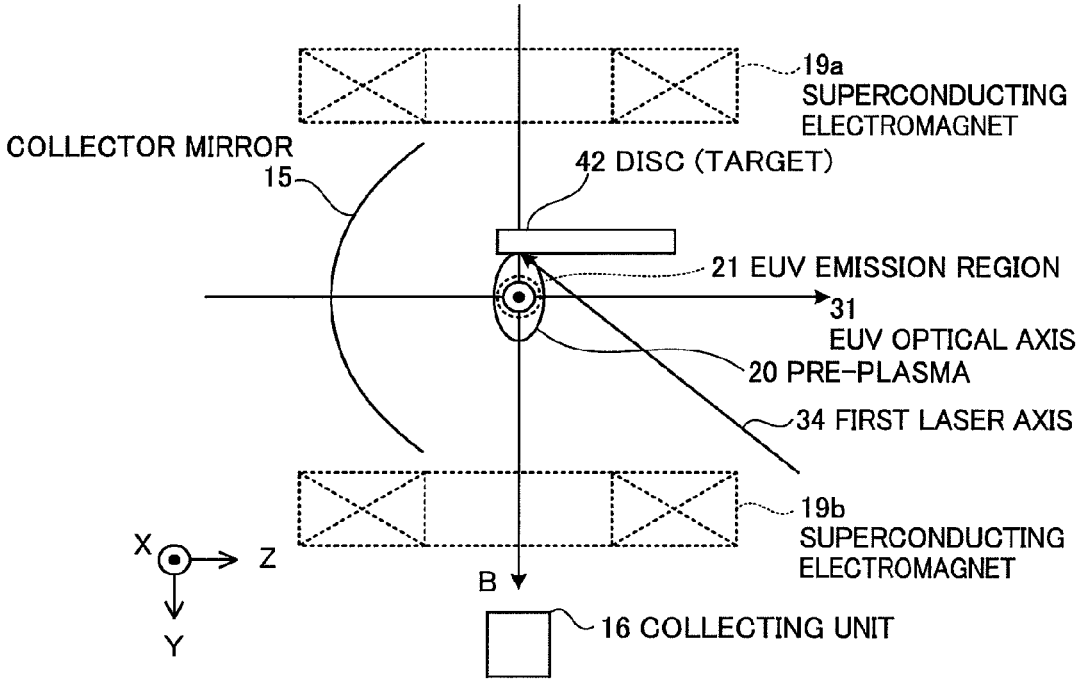
FIGS. 15A and 15B are a side view and a bottom view showing a schematic configuration within an EUV light source apparatus according to the eleventh embodiment.
Figure 15B:
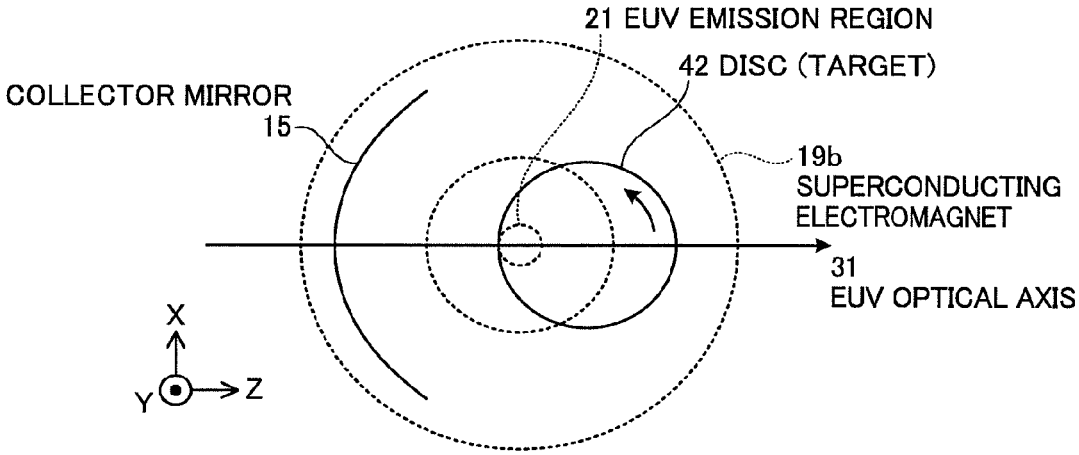

FIGS. 15A and 15B are a side view and a bottom view showing a schematic configuration within an EUV light source apparatus according to the eleventh embodiment. As below, the explanation will be made with the upside of FIG. 15A as the upper surface side and the right side of the drawings as the front surface side.

In the eleventh embodiment, a disc 42 as a solid is used as the target. The disc 42 is formed of tin (Sn), for example, or another material coated with tin.

In the eleventh embodiment, the EUV optical axis 31 is in a direction from the plasma emission point toward the front surface side as is the case of the first embodiment. The magnetic field axis "B" is formed in a direction toward the bottom surface side, and substantially perpendicular to the EUV optical axis 31. The magnetic field "B" is formed by the superconducting electromagnets 19*a* and 19*b* provided outside of the chamber as is the case of the first embodiment. The first laser axis 34 is formed in a direction obliquely toward the upper surface side.

In FIGS. 15A and 15B, the direction of the magnetic field axis "B" is downward. However, even when the direction of the magnetic field axis "B" is upward, it may execute the same function. The reason is that the ions, which have been turned into pre-plasma, converge and move along the magnetic field axis regardless of the direction of the magnetic field axis "B".

The disc 42 is provided such that the flat bottom surface of the disc 42 is in a direction substantially perpendicular to the direction of the magnetic field axis "B". In the arrangement, the first laser beam is applied to near the end of the flat bottom surface of the disc 42 along the first laser axis 34, and thereby, the pre-plasma 20 can be generated substantially in the same direction as the normal direction of the flat bottom surface of the disc 42 (the direction of the magnetic field axis "B"). By applying the second laser beam to the pre-plasma 20, EUV light can be radiated from the EUV emission region 21. By rotating the disc 42 sequentially along the circumference of the disc 42, the first laser beam can be applied to the new surface of the disc 42 to generate the pre-plasma 20.

Here, the second laser axis is not shown. The second laser axis may be in a direction substantially perpendicular to the EUV optical axis 31 and substantially perpendicular to the magnetic field axis "B" in the same manner as the first embodiment, or substantially in the same direction as that of the magnetic field axis "B" in the same manner as the fourth embodiment, or substantially in the same direction as that of the EUV optical axis 31 in the same manner as the fifth embodiment.

According to the configuration of the eleventh embodiment, since the solid target is used, the same advantages as those of the ninth embodiment can be exerted. Further, according to the eleventh embodiment, since the first laser beam is applied to the flat bottom surface of the disc 42, unlike the curved surface of the spherical droplet in the first to eighth embodiments and the side surface of the wire 41 in the ninth embodiment, the pre-plasma 20 is generated in the perpendicular direction from the flat bottom surface of the disc 42, and the convergence condition of the pre-plasma 20 can be made better.

Figure 16A:
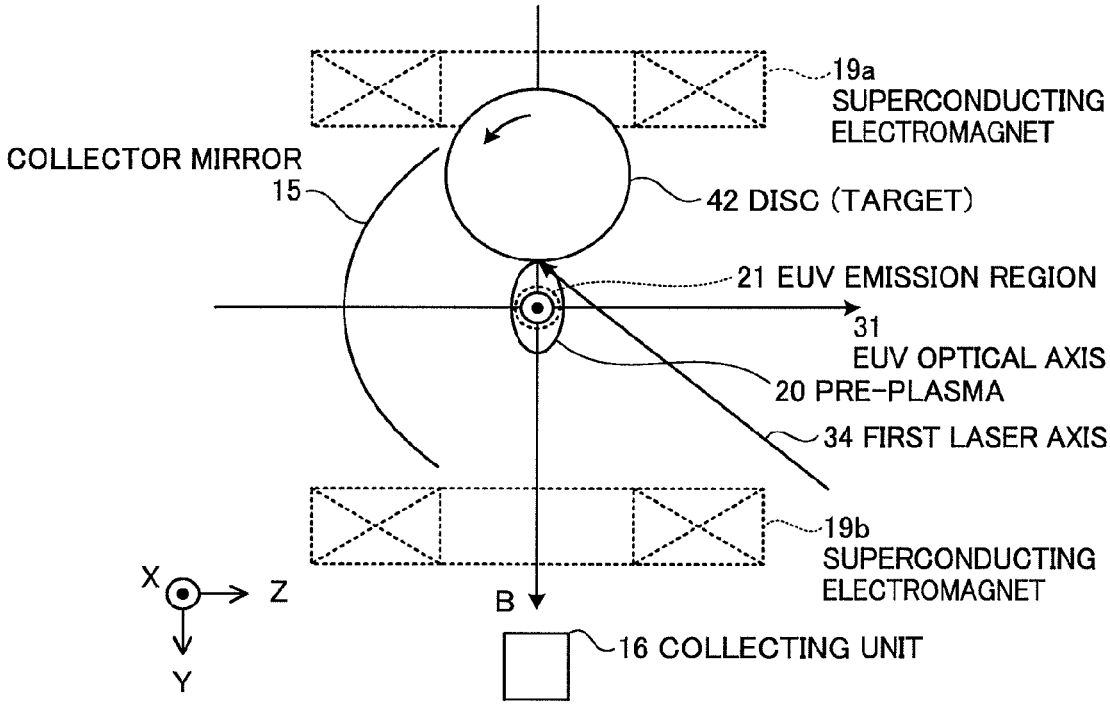
FIGS. 16A and 16B are a side view and a bottom view showing a schematic configuration within an EUV light source apparatus according to the twelfth embodiment.
Figure 16B:
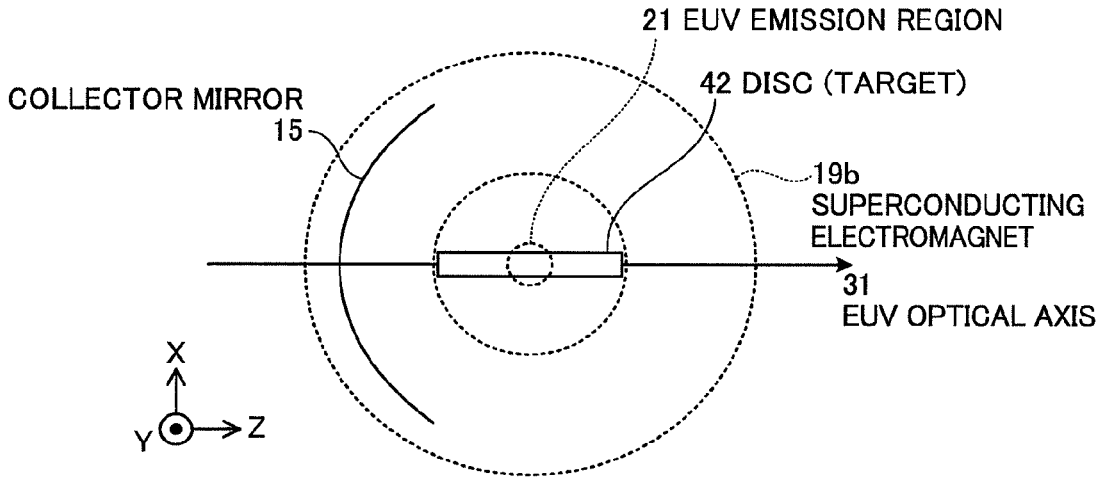

FIGS. 16A and 16B are a side view and a bottom view showing a schematic configuration within an EUV light source apparatus according to the twelfth embodiment. While the disc 42 is provided such that the flat bottom surface of the disc 42 is in the direction substantially perpendicular to the direction of the magnetic field axis "B" in the above-mentioned eleventh embodiment, the disc 42 is provided such that the flat bottom surface of the disc 42 is in a direction substantially in parallel to the direction of the magnetic field axis "B" and substantially in parallel to the EUV optical axis 31 in the twelfth embodiment.

In the arrangement, the first laser beam is applied from below to the side surface of the disc 42 along the first laser axis 34, and thereby, the pre-plasma 20 can be generated from the side surface of the disc 42 substantially in the same direction as the direction of the magnetic field axis "B". By applying the second laser beam to the pre-plasma 20, EUV light can be radiated from the EUV emission region 21. By rotating the disc 42 sequentially along the circumference of the disc 42, the first laser beam can be applied to the new surface of the disc 42 to generate the pre-plasma 20.

In FIGS. 16A and 16B, the direction of the magnetic field axis "B" is downward. However, even when the direction of the magnetic field axis "B" is upward, it may execute the same function. The reason is that the ions, which have been turned into pre-plasma, converge and move along the magnetic field axis regardless of the direction of the magnetic field axis "B".

Here, the second laser axis is not shown. The second laser axis may be in a direction substantially perpendicular to the EUV optical axis 31 and substantially perpendicular to the magnetic field axis "B" in the same manner as the first embodiment, or substantially in the same direction as that of the magnetic field axis "B" in the same manner as the fourth embodiment, or substantially in the same direction as that of the EUV optical axis 31 in the same manner as the fifth embodiment.

According to the configuration of the twelfth embodiment, since the first laser beam is applied to the side surface of the disc 42 having a large radius of curvature, unlike the curved surface of the spherical droplet in the first to eighth embodiments and the side surface of the wire 41 in the ninth embodiment, the pre-plasma 20 is generated in the perpendicular direction from the side surface of the disc 42, and the convergence condition of the pre-plasma 20 can be made better.

Figure 17B:
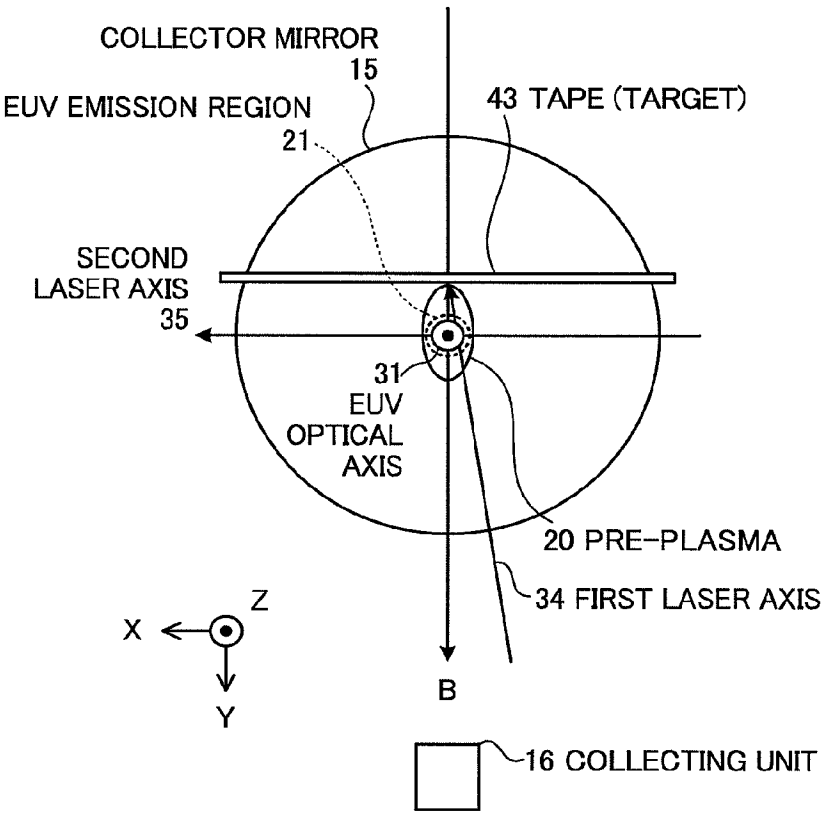
FIGS. 17A and 17B are a side view and a front view showing a schematic configuration within an EUV light source apparatus according to the thirteenth embodiment.
Figure 17A:
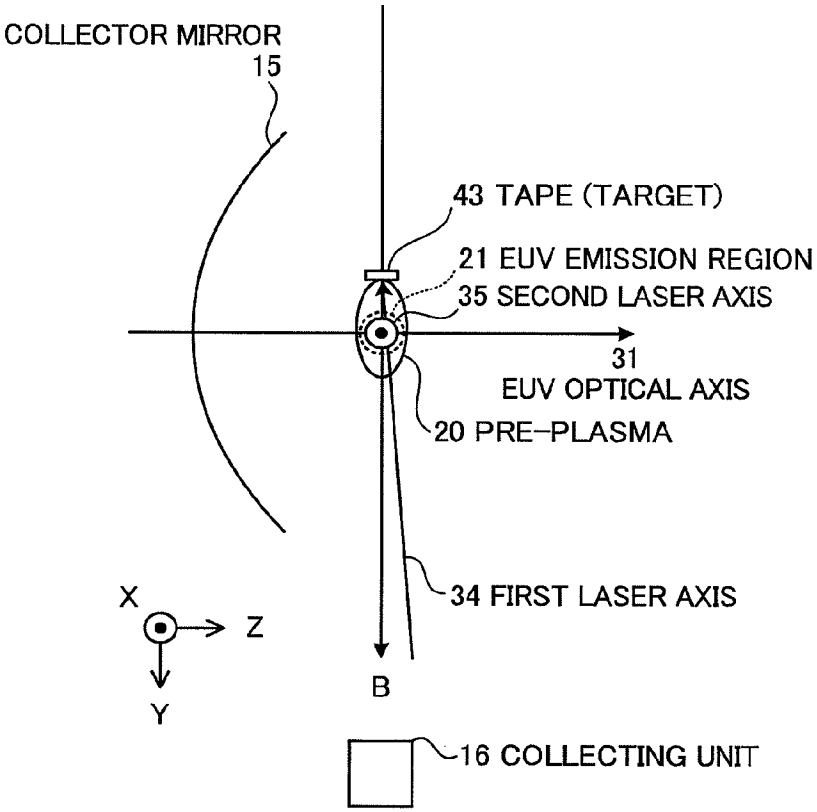

FIGS. 17A and 17B are a side view and a front view showing a schematic configuration within an EUV light source apparatus according to the thirteenth embodiment. While the wire 41 is used as the target in the above-mentioned ninth embodiment, a tape 43 is used as the target in the thirteenth embodiment. The tape 43 is formed of a resin film coated with tin (Sn), for example.

According to the thirteenth embodiment, since the solid target is used, the same advantages as those of the ninth embodiment can be exerted. Further, according to the thirteenth embodiment, since the first laser beam is applied to the flat surface of the tape 43, unlike the curved surface of the spherical droplet in the first to eighth embodiments and the side surface of the wire 41 in the ninth embodiment, the pre-plasma 20 is generated in the perpendicular direction from the flat surface of the tape 43, and the convergence condition of the pre-plasma 20 can be made better. Furthermore, the tape before and after use can be winded and accommodated within the chamber in a compact form.

Figure 18B:
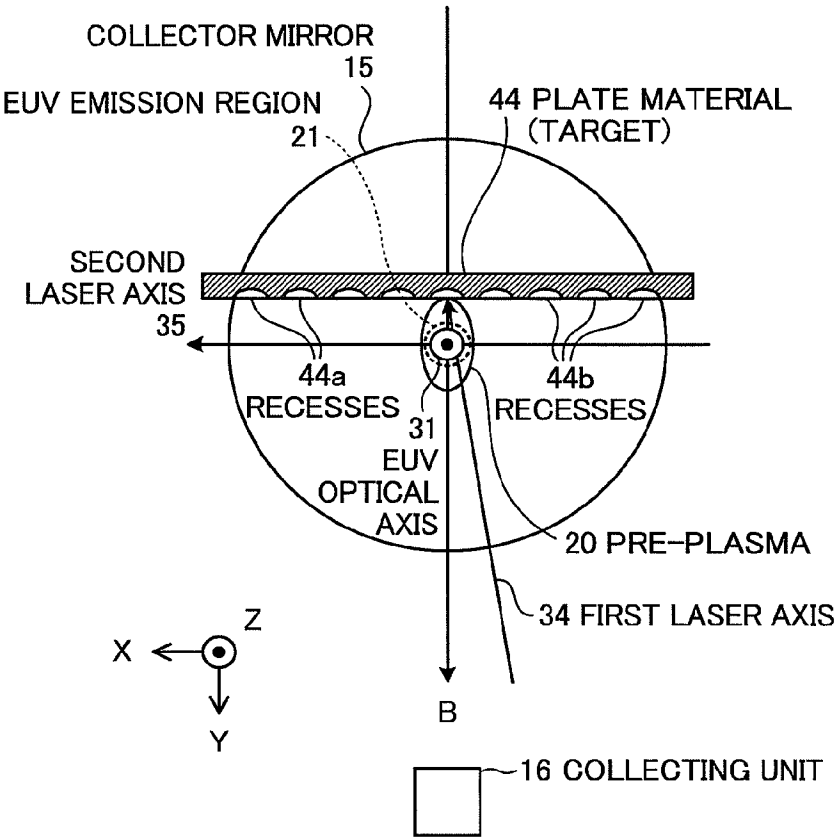
FIGS. 18A and 18B are a side view and a front view showing a schematic configuration within an EUV light source apparatus according to the fourteenth embodiment.
Figure 18A:
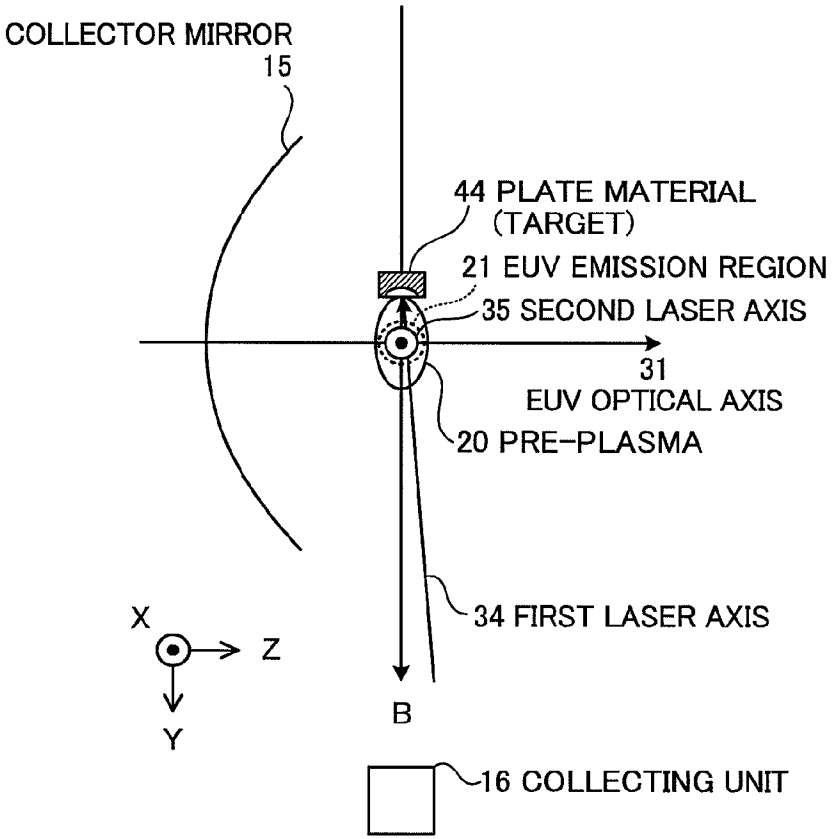

FIGS. 18A and 18B are a side view and a front view showing a schematic configuration within an EUV light source apparatus according to the fourteenth embodiment. While the wire 41 is used as the target in the above-mentioned ninth embodiment, a plate material 44, on which many recesses 44*a* are formed, is used as the target in the fourteenth embodiment. The plate material 44 is formed of tin (Sn), for example, or another material coated with tin at least within the individual recesses 44*a*.

According to the fourteenth embodiment, since the solid target is used, the same advantages as those of the ninth embodiment can be exerted. Further, according to the fourteenth embodiment, since the first laser beam is applied into the recesses 44*a* and the pre-plasma 20 is generated, and thereby, the diffusion of the pre-plasma can be suppressed and the pre-plasma can be formed in a direction in which the pre-plasma is converged. As a result, the density of the pre-plasma becomes optimum for conversion into EUV light by the second laser beam, and thereby, the conversion efficiency is further improved compared to the case of the tape target.

Next, the fifteenth embodiment will be explained.

Figure 19:
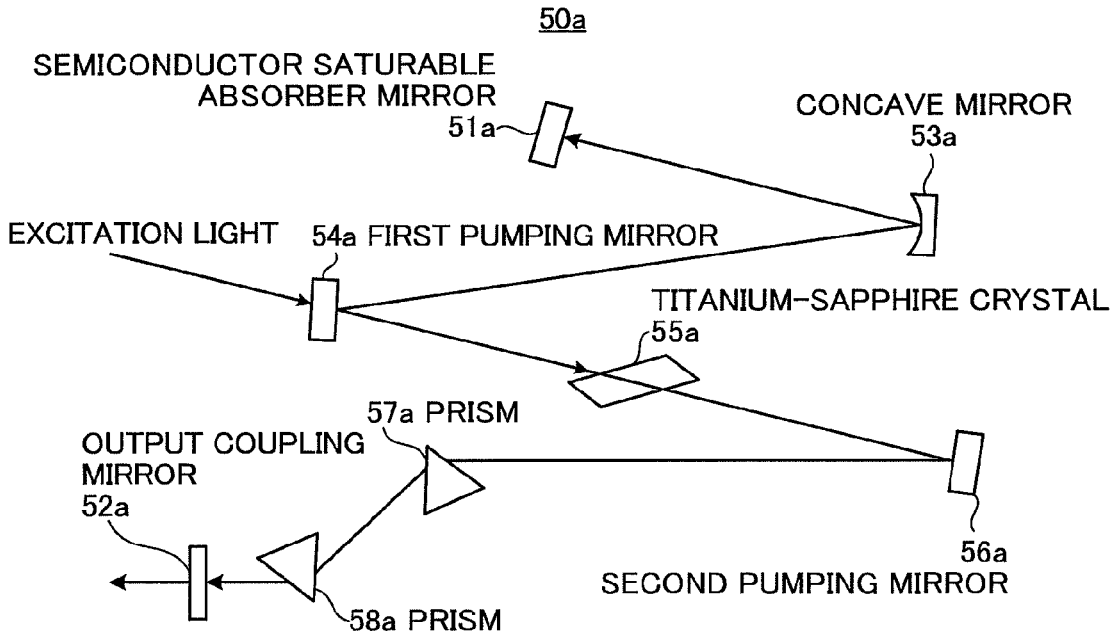
FIG. 19 is a schematic diagram showing a configuration example of a first laser oscillator in an EUV light source apparatus according to the fifteenth embodiment.

FIG. 19 is a schematic diagram showing a configuration example of a first laser oscillator in an EUV light source apparatus according to the fifteenth embodiment. A first laser oscillator 50*a* in the fifteenth embodiment is provided outside of the chamber, as the first laser oscillator for generating the first laser beam for generating the pre-plasma in the above-mentioned first to fourteenth embodiments.

The first laser oscillator 50*a* in the fifteenth embodiment includes a concave mirror 53*a*, a first pumping mirror 54*a*, a titanium-sapphire crystal 55*a*, a second pumping mirror 56*a*, and two prisms 57*a* and 58*a* arranged in this order between a semiconductor saturable absorber mirror 51*a* and an output coupling mirror 52*a*. The first pumping mirror 54*a* is a mirror for transmitting excitation light and highly reflecting the first laser beam. The concave mirror 53*a* and the second pumping mirror 56*a* are highly reflective mirrors for the first laser beam.

Into the first pumping mirror 54*a*, second harmonics outputted from a semiconductor excitation Nd:$YVO_4$ (neodymium doped yttrium orthovanadate) laser is introduced as the excitation light, and oscillation is performed by synchronizing the semiconductor saturable absorber mirror 51*a* and the longitudinal mode of the laser oscillator, and thereby, a pulsed laser beam having pulse duration of picoseconds is outputted. In the case where the pulse energy is small, the pulsed laser beam may be amplified by a regenerative amplifier.

According to the fifteenth embodiment, since the short-pulsed laser beam having pulse duration of picoseconds is applied as the first laser beam to the target, only the thin surface of the target can be turned into pre-plasma. Therefore, the inside of the target is not heated, and the production of neutral particles can be suppressed. Further, the pre-plasma can be generated with small pulse energy.

Here, in the case where a droplet target is used as the target, because of using the short-pulsed laser beam having pulse duration of picoseconds, production of a spray due to breakage of the droplets can be suppressed and contamination of the optical components within the chamber can be suppressed.

Alternatively, in the case where a solid-state target is used as the target, because of using the short-pulsed laser beam having pulse duration of picoseconds, the internal damage of the target is prevented and the target material such as tin can be recoated and repeatedly used. Further, since the part of the target material, that is not turned into plasma, remains as the target material without change, only the thin surface of the target is turned into pre-plasma and the amount of consumed target can be made smaller.

Next, the sixteenth embodiment will be explained.

Figure 20:
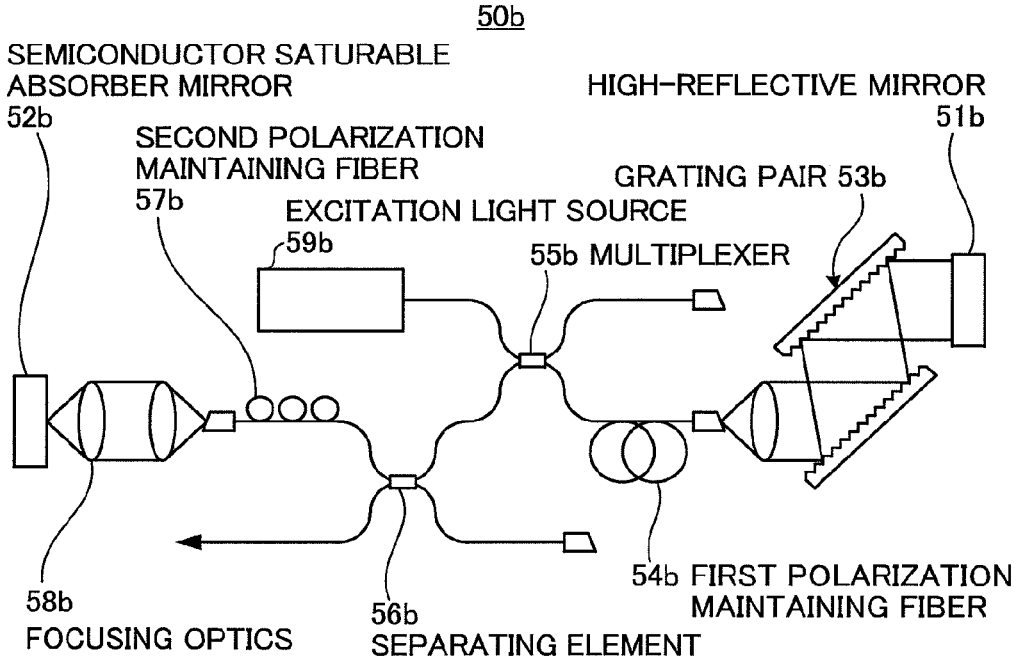
FIG. 20 is a schematic diagram showing a configuration example of the first laser oscillator in an EUV light source apparatus according to the sixteenth embodiment.

FIG. 20 is a schematic diagram showing a configuration example of the first laser oscillator in an EUV light source apparatus according to the sixteenth embodiment. A first laser oscillator 50*b* in the sixteenth embodiment is provided outside of the chamber, as the first laser oscillator for generating the first laser beam for generating the pre-plasma in the first to fourteenth embodiments.

The first laser oscillator 50*b* in the sixteenth embodiment includes a grating pair 53*b*, a first polarization maintaining fiber 54*b*, a multiplexer 55*b* for coupling excitation light, a separating element 56*b* for separating an output beam, a second polarization maintaining fiber 57*b*, and focusing optics 58*b* arranged in this order between a high-reflective mirror 51*b* and a semiconductor saturable absorber mirror 52*b*. The first polarization maintaining fiber 54*b* is doped with ytterbium (Yb). When the excitation light is introduced from an excitation light source 59*b* connected to the multiplexer 55*b* with an optical fiber, a pulsed laser beam having pulse duration of picoseconds is outputted.

Here, a picosecond pulse laser for outputting the pulsed laser beam having pulse duration of picoseconds refers to a pulse laser for outputting a pulsed laser beam having pulse duration "T" that is less than 1 ns (T<1 ns). Further, in the case where a femtosecond pulse laser for outputting a pulsed laser beam having pulse duration of femtoseconds is applied to the present invention, the same advantages can be obtained.

According to the sixteenth embodiment, not only the same advantages as those of the fifteenth embodiment are exerted, but also high-accuracy application of the first later beam to the target becomes easier because the first laser beam can be introduced by the optical fiber. Further, generally in a fiber laser, $M^2$-value expressing the shift of the intensity distribution of the laser beam from the ideal Gaussian distribution is about 1.2 and the focusing capability is high, and thereby, the first laser beam can be applied to a small target with high accuracy.

The shorter the wavelength of the first laser beam becomes, the higher the absorption of the laser beam by tin becomes. Therefore, in the case of emphasizing the absorption of the laser beam by tin, the wavelength of the first laser beam must be shorter. For example, compared with the wavelength 1064 nm of a fundamental wave outputted from Nd:YAG (neodymium doped yttrium aluminum garnet) laser, the absorption efficiency becomes higher in the order of harmonics $2\omega$=532 nm, $3\omega$=355 nm, and $4\omega$=266 nm. As the wavelength is shorter, only shallow surface of the tin metal efficiently absorbs the laser beam, and the pre-plasma can be generated with high efficiency. As a result, the conversion efficiency from the energy of the first laser beam into the energy of EUV light is improved.

The invention claimed is:

1. An extreme ultraviolet light source apparatus for generating extreme ultraviolet light by generating plasma of a target material within a chamber, said apparatus comprising:

a target supply unit configured to supply the target material into said chamber;

a collecting unit positioned to face said target supply unit and configured to collect at least a part of the target material;

a first laser unit including a saturable absorber mirror and configured to irradiate the target material with a first laser beam;

a second laser unit configured to irradiate the target material, which has been irradiated with the first laser beam, with a second laser beam to generate the plasma for radiating the extreme ultraviolet light;

a laser dumper disposed in an optical path of the second laser beam and configured to absorb the second laser beam;

collective optics configured to collect the extreme ultraviolet light from the plasma to output the extreme ultraviolet light; and a magnetic field generator configured to generate a magnetic field within said chamber.

2. The extreme ultraviolet light source apparatus according to claim 1, wherein an optical axis direction of said first laser beam is substantially the same as an optical axis direction of the extreme ultraviolet light collected by said collective optics.

3. The extreme ultraviolet light source apparatus according to claim 2, wherein:

said magnetic field generator includes two electromagnetic coils; and optics for said first laser beam is provided to irradiate the target material with the first laser beam, the target material being irradiated through a space between said two electromagnetic coils with the first laser beam.

4. The extreme ultraviolet light source apparatus according to claim 2, wherein the optical axis direction of said first laser beam is substantially in parallel to an axis direction of said magnetic field near to a generation region of the extreme ultraviolet light.

5. The extreme ultraviolet light source apparatus according to claim 2, wherein a supply direction of said target material from said target supply unit is substantially perpendicular to an axis direction of said magnetic field near to a generation region of the extreme ultraviolet light.

6. The extreme ultraviolet light source apparatus according to claim 2, wherein an axis direction of said magnetic field near to a generation region of the extreme ultraviolet light is substantially in parallel to an optical axis direction of the extreme ultraviolet light collected by said collective optics.

7. The extreme ultraviolet light source apparatus according to claim 2, wherein said magnetic field generator is disposed in an obscuration area.

8. The extreme ultraviolet light source apparatus according to claim 2, wherein a supply direction of said target material from said target supply unit is substantially perpendicular to the optical axis direction of the extreme ultraviolet light collected by said collective optics.

9. The extreme ultraviolet light source apparatus according to claim 1, wherein an optical axis direction of said first laser beam is substantially opposite to a supply direction of said target material from said target supply unit.

10. The extreme ultraviolet light source apparatus according to claim 1, wherein an optical axis direction of said second laser beam is substantially the same as an optical axis direction of the extreme ultraviolet light collected by said collective optics.

11. The extreme ultraviolet light source apparatus according to claim 10, wherein the optical axis direction of said second laser beam is substantially perpendicular to an optical axis direction of said first laser beam.

12. The extreme ultraviolet light source apparatus according to claim 10, wherein the optical axis direction of said second laser beam is substantially in parallel to an axis direction of the magnetic field generated by said magnetic field generating unit.

13. The extreme ultraviolet light source apparatus according to claim 10, wherein the optical axis direction of said second laser beam passes through a hole formed at a center of said collective optics.

14. The extreme ultraviolet light source apparatus according to claim 1, wherein said first laser unit includes a pulse laser configured to generate a pulse laser beam having duration less than one nanosecond.

15. The extreme ultraviolet light source apparatus according to claim 1, wherein said target supply unit comprises a vibration mechanism including a piezoelectric element.

16. The extreme ultraviolet light source apparatus according to claim 1, wherein said first laser unit includes a femtosecond pulse laser.

17. The extreme ultraviolet light source apparatus according to claim 1, wherein said first laser unit includes a regenerative amplifier.

18. The extreme ultraviolet light source apparatus according to claim 1, wherein said first laser unit includes one of a titanium-sapphire crystal, an Nd:$YVO_4$ (neodymium doped yttrium orthovanadate) crystal, and an Nd:YAG (neodymium doped yttrium aluminum garnet) crystal.

19. The extreme ultraviolet light source apparatus according to claim 1, wherein said first laser unit includes optics doped with ytterbium (Yb).

20. The extreme ultraviolet light source apparatus according to claim 19, wherein said optics includes an optical fiber doped with ytterbium (Yb).

21. The extreme ultraviolet light source apparatus according to claim 1, wherein said first laser unit includes plural gratings.

22. The extreme ultraviolet light source apparatus according to claim 1, further comprising a gate valve disposed in an output optical path of the extreme ultraviolet light collected by said collective optics.

* * * * *